US009919860B2

(12) United States Patent
Dabah et al.

(10) Patent No.: US 9,919,860 B2
(45) Date of Patent: Mar. 20, 2018

(54) CAP DEVICE AND METHODS

(71) Applicants: Yaacov Dabah, Great Neck, NY (US); Dror Fold, Glen Cove, NY (US); Richard Flaks, Short Hills, NJ (US); Martin Binder, Erie, PA (US); Coy M. Herald, Loveland, OH (US)

(72) Inventors: Yaacov Dabah, Great Neck, NY (US); Dror Fold, Glen Cove, NY (US); Richard Flaks, Short Hills, NJ (US); Martin Binder, Erie, PA (US); Coy M. Herald, Loveland, OH (US)

( * ) Notice: Subject to any disclaimer, the term of this patent is extended or adjusted under 35 U.S.C. 154(b) by 0 days.

(21) Appl. No.: 13/894,693

(22) Filed: May 15, 2013

(65) Prior Publication Data

US 2013/0306642 A1 Nov. 21, 2013

Related U.S. Application Data

(60) Provisional application No. 61/647,250, filed on May 15, 2012, provisional application No. 61/782,552, filed on Mar. 14, 2013.

(51) Int. Cl.
*B65D 81/32* (2006.01)
*B65D 51/28* (2006.01)

(52) U.S. Cl.
CPC ..... *B65D 81/3255* (2013.01); *B65D 51/28* (2013.01); *B65D 51/2821* (2013.01)

(58) Field of Classification Search
CPC ..... B65D 51/28; B65D 51/2821; B65D 81/3211; B65D 81/3255; B65D 51/2807; B65D 51/247
USPC ..... 220/251, 293, 296, 802; 206/222; 215/DIG. 8; 222/83
See application file for complete search history.

(56) References Cited

U.S. PATENT DOCUMENTS

| | | | |
|---|---|---|---|
| 3,521,745 | A | 7/1970 | Schwartzman |
| 3,603,469 | A | 9/1971 | Magni |
| 3,968,872 | A | 7/1976 | Cavazza |
| 4,195,731 | A | 4/1980 | Cavazza |
| 4,648,532 | A | 3/1987 | Green |
| 4,858,760 | A | 8/1989 | Di Sturco |
| 5,772,017 | A | 6/1998 | Kang |
| 5,941,380 | A | 8/1999 | Rothman |
| 5,971,140 | A | 10/1999 | Frutin |
| 6,152,296 | A | 11/2000 | Shih |
| 6,165,523 | A | 12/2000 | Story |
| 6,305,576 | B1 | 10/2001 | Leoncavallo |

(Continued)

FOREIGN PATENT DOCUMENTS

| | | | |
|---|---|---|---|
| EP | 0954488 | B1 | 11/1999 |
| EP | 1682443 | B1 | 7/2006 |

(Continued)

OTHER PUBLICATIONS

International Application No. PCT/US2013/041173 ISR and WO dated Jul. 30, 2013.

*Primary Examiner* — King M Chu
*Assistant Examiner* — James M Van Buskirk

(57) ABSTRACT

Aspects described herein provide cap devices for dispensing a composition, the cap devices having chambers, shells, cutting elements, piercers, dust covers, and films. Methods of using the cap devices are also provided. The chambers or shells can contain a composition to be added to the container for consumption.

2 Claims, 33 Drawing Sheets

(56) References Cited

U.S. PATENT DOCUMENTS

| | | | |
|---|---|---|---|
| 6,513,650 | B2 | 2/2003 | Mollstam et al. |
| 6,527,110 | B2 | 3/2003 | Moscovitz |
| 6,533,113 | B2 | 3/2003 | Moscovitz |
| 6,540,070 | B1 | 4/2003 | Conwell |
| 6,854,595 | B2 | 2/2005 | Kiser |
| 6,935,493 | B2 | 8/2005 | Cho |
| 6,959,839 | B2 | 11/2005 | Roth et al. |
| 7,055,685 | B1 | 6/2006 | Patterson et al. |
| 7,249,690 | B2 | 7/2007 | Smith et al. |
| 7,306,117 | B2 | 12/2007 | Roth et al. |
| 7,308,915 | B2 | 12/2007 | Johns et al. |
| 7,464,811 | B2 | 12/2008 | Patterson et al. |
| 7,475,774 | B2 | 1/2009 | Clarkson |
| 7,503,453 | B2 | 3/2009 | Cronin et al. |
| 7,506,782 | B2 | 3/2009 | Walters et al. |
| 7,854,104 | B2 | 12/2010 | Cronin et al. |
| 7,909,160 | B2 | 3/2011 | Patterson et al. |
| 8,142,827 | B2 | 3/2012 | Bell |
| 8,276,748 | B2 | 10/2012 | Nyambi et al. |
| 8,297,456 | B1 | 10/2012 | Anderson |
| 8,328,010 | B2 | 12/2012 | Lee et al. |
| 8,356,711 | B2 | 1/2013 | Canziani Hoffa et al. |
| 8,376,175 | B2 | 2/2013 | Gonzalez |
| 8,413,802 | B2 | 4/2013 | Lee et al. |
| 8,443,969 | B2 | 5/2013 | Nyambi et al. |
| 8,485,353 | B2 | 7/2013 | Lee et al. |
| 2003/0006247 | A1 | 1/2003 | Olivier et al. |
| 2005/0173271 | A1 | 8/2005 | Levi |
| 2008/0202950 | A1 | 8/2008 | Anderson |
| 2009/0308831 | A1 | 12/2009 | Anderson |
| 2010/0078438 | A1 | 4/2010 | Lee et al. |
| 2010/0236952 | A1* | 9/2010 | Masterson ..... B65D 51/2835 206/222 |
| 2011/0024454 | A1 | 2/2011 | Dyrbye et al. |
| 2011/0163119 | A1 | 7/2011 | Nyambi et al. |
| 2011/0266170 | A1 | 11/2011 | Ligon |
| 2011/0269802 | A1 | 11/2011 | Ligon |
| 2012/0085761 | A1 | 4/2012 | Gonzalez |
| 2012/0199503 | A1 | 8/2012 | Dyrbye et al. |
| 2012/0228313 | A1 | 9/2012 | Wang |
| 2013/0095213 | A1* | 4/2013 | Walters ..... A21D 2/36 426/87 |

FOREIGN PATENT DOCUMENTS

| | | | |
|---|---|---|---|
| EP | 1968867 | B1 | 9/2008 |
| EP | 2019792 | B1 | 2/2009 |
| WO | 2004113190 | A1 | 12/2004 |

* cited by examiner

CAP DEVICE AND METHODS

PRIORITY CLAIM

This application claims priority to U.S. Provisional Patent Application Ser. No. 61/647,250, filed May 15, 2012, and U.S. Provisional Application Ser. No. 61/782,552 filed Mar. 14, 2013. Each of the above referenced applications is incorporated herein by reference as if restated in full.

BACKGROUND

Conventional liquid beverages are distributed in disposable containers with all of the ingredients of the beverage pre-mixed with the liquid beverage inside the container. The liquid is either pasteurized or contains preservatives to prevent degradation of ingredients that are suspended or dissolved in the liquid. Any additional ingredients that are not be pre-mixed with the liquid prior to distribution but that are designed to be added to the liquid before consumption are conventionally kept separate from the liquid in a second container. Keeping additional ingredients separate from the liquid in a second container is inconvenient for the consumer, who must then add the additional ingredients from the second container into the container holding the liquid. Also, the consumer must accurately measure and combine the ingredients, because variations in the ratio of additional ingredients to liquid may alter the properties (e.g., taste, viscosity, organoleptic properties, etc.) of the final beverage.

Disposable containers typically include a cap designed to provide a leak-resistant seal over the opening of the container containing the liquid, for example, over the mouth of a bottle. A cap that could contain additional ingredients separate from the liquid while allowing the user to add the additional ingredients to the liquid and still provide a leak-resistant seal would be desirable.

SUMMARY

Cap devices are provided for retaining and adding compositions to, for example, liquid-filled containers. In this manner, fresh ingredients can be mixed with liquids just prior to consumption maximizing the stability, taste, and activity of the ingredients. In one aspect, the cap devices have at least a shell and a chamber wherein the shell or chamber contains the dry or liquid ingredients which are released when pierced or cut by a cutting element. The cutting element can be disposed on either the shell or chamber and can be actuated by a consumer, for example, applying force to the chamber or shell resulting in piercing or cutting of the film and release of the ingredients into a liquid in the container. Features of the chamber and shell are provided to facilitate the flow of liquid such that substantially all the ingredients in the chamber or shell are released into the container. Further aspects prevent the liquid from being retained in the chamber or shell after the ingredients are removed.

Aspects described herein provide cap devices adapted for containers (e.g., disposable or recyclable containers). In one aspect, the cap devices provide a shell adapted to be associated with a container and a chamber containing a composition and adapted to associate with the shell. In another aspect, the chamber has a film which prevents the composition from being released until desired. In this aspect, when the chamber is actuated and moved into the shell (e.g., with a downward or rotational force), the film is pierced or cut by a cutting element in the shell and the composition is released into the container. In another aspect, the chamber can be removable, replaceable (e.g., disposed after use and replaced with another chamber), or rechargeable (e.g., additional composition can be added and the film can be replaced) or a combination of these features. In another aspect, the container has a liquid (e.g., water, juice, soda, oil, cosmetics, shampoo etc.) disposed within and the composition is mixed with the liquid before consumption or use by a consumer.

In further aspects described herein, cap devices include a shell for containing a composition and adapted to be associated with a container and a chamber having a cutting element adapted to associate with the shell. In another aspect, the shell has a film which prevents the composition from being released until desired. In this aspect, when the chamber is actuated and moved into the shell (e.g., with a downward or rotating force), the film is pierced or cut by a cutting element associated with the chamber and the composition is released into the container. In another aspect, the chamber or shell containing the composition can be removable, replaceable (e.g., disposed after use and replaced with another chamber), rechargeable (e.g., additional composition can be added and the film can be replaced) or a combination of these features. In another aspect, the container has a liquid (e.g., water, juice, soda, cosmetics, shampoo etc.) disposed within and the composition is mixed with the liquid before consumption or use by a consumer.

Aspects herein provide a cap device comprising a shell for associating the cap with a container. In this aspect, the shell has a cutting element for cutting or piercing a film, and at least two or three sets of locking beads (e.g., an uppermost set of locking beads, a middle set of locking beads, and a lower set of locking beads) where each set of locking bead comprises one or more locking beads at substantially the same vertical distance from a top portion of the shell. This aspect also provides a chamber for containing a composition where the chamber has one or more side walls comprising at least one to three continuous seal beads for engaging the at least two or three sets of locking beads. This exemplary chamber also has one or more top walls attached to the one or more side walls, an opening opposite the one or more top walls, and a film covering at least part of the opening.

Another aspect provides a shell for associating the cap device with a container. In this aspect, the shell has a shell base, a shell basket, a chimney, and a cutting element for cutting or piercing a film. This aspect also provides a chamber adapted to associate with the shell for containing a composition. This exemplary chamber has one or more side walls having at least one protrusion (e.g., elevated line, indentation, circle, rhomboid, rectangle, or any other suitably shaped elevation), for example, on an inner side wall of the chamber, one or more top walls attached to the one or more side walls, at least one opening, and a film adapted to cover at least part of the opening. In one aspect, the protrusion facilitates water flow such that (1) substantially all of the composition is removed from the chamber when the container is agitated and the liquid is mixed with the composition and (2) liquid does remain associated with the chamber or shell after the container is agitated and, for example, while the liquid is being consumed.

Another aspect provides a chamber adapted to associate with a shell for containing a composition. In this aspect, the chamber has one or more side walls having at least one protrusion, one or more top walls attached to the one or side walls, at least one opening, and a film adapted to cover at least part of the at least one opening.

Yet another aspect provides a shell for associating a cap device with a container. In this aspect, the shell has a shell base, a shell basket, a shell chimney, and a cutting element for cutting or piercing a film. This aspect also provides a chamber for containing a composition and adapted to associate with the shell. In this aspect, the chamber has one or more side walls having an inner side wall with a lower portion and an upper portion. In this aspect, the width of the lower portion is greater than the width of the upper portion or the width of the lower portion is less than the width of the upper portion. This exemplary chamber also has one or more top walls attached to the one or more side walls, at least one opening, and a film adapted to cover at least part of the at least one opening.

Another aspect provides a shell for associating a cap device with a container, the shell having a chimney with a top portion and a lower portion, wherein shell threads are disposed on the chimney from the top portion to the lower portion. This aspect also provides a chamber for containing a composition and adapted to associate with the shell. In this aspect, the chamber has one or more side walls having a top portion, a middle portion, and a lower portion. In this aspect chamber threads are disposed on the middle portion and are adapted to sealably or rotatably engage with the shell threads. In this aspect, the chamber has one or more top walls attached to the one or more side walls, at least one opening, and a film adapted to cover at least part of the at least one opening.

Another aspect provides a shell and chamber for associating a cap device with a container. In this aspect, the shell has a shell base, a shell basket, a shell chimney, and a cutting element for cutting or piercing a film and a chamber for containing a composition and adapted to associate with the shell. In this aspect, the chamber has one or more side walls having a top portion and a lower portion wherein a mold or seal is disposed on the lower portion to sealably engage with the shell chimney. In one aspect, the mold or seal is disposed on substantially the entire perimeter of the lower or middle portion of the shell. In this aspect, the chamber has one or more top walls attached to the one or more side walls, at least one opening, and a film adapted to cover at least part of the at least one opening.

Further aspects provide a shell and chamber for associating a cap device with a container. In this aspect, the chamber has chamber threads disposed on one or more side walls. This aspect also provides a shell with shell threads and optional beads disposed on the shell chimney. In this aspect, when the chamber threads engage with the shell threads, the chamber cannot be readily actuated into the shell. When the chamber is rotated with respect to the shell, for example beyond the length of the chamber threads and the shell threads, the chamber threads disengage from the shell threads. When the chamber threads disengage from the shell threads, the chamber is capable of being actuated into the shell.

Aspects also provide a shell and chamber for associating a cap device with a container. In another aspect, the shell has locking slots (e.g., depressions, hole, gaps) adapted for receiving locking beads disposed, for example, on the shell chimney or chamber, and a cutting element. This aspect also provides a chamber with locking beads and locking protrusions disposed on the side walls. In this aspect, the chamber can be rotated with respect to the shell in order to, for example, align the locking slots on the shell with the locking protrusions on the chamber so that the chamber can be actuated and inserted into the shell.

DETAILED DESCRIPTION

Figure 1:
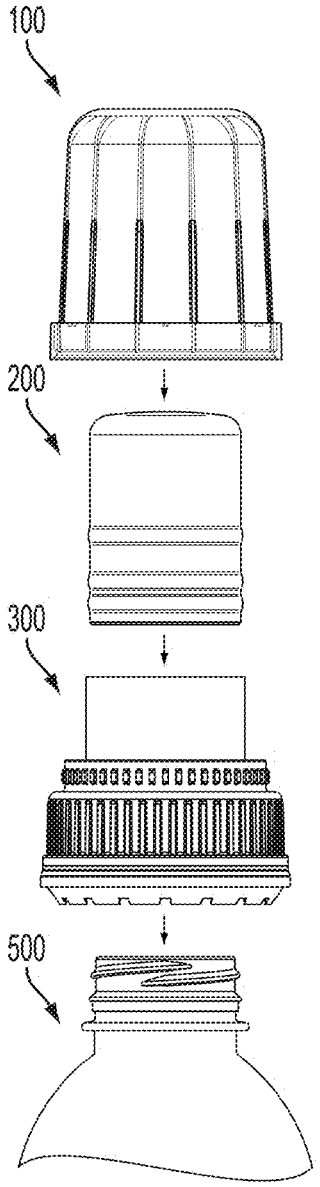
FIG. 1 is a side view of an exemplary cap device having a dust cover, chamber, and cap shell.

A cap dispensing device can contain a chamber for housing a required amount of additional ingredients. The chamber can have any required volume, for example, about 5 mL to about 20 mL, about 10 mL to about 15 mL, or about 13 mL; for solids with a density of about 0.8 g/mL, this equates to a solid capacity of about 4 g to about 16 g, or about 8 g to about 12 g, or about 10 g. The chamber need not contain any particular type of ingredient. In one aspect, an ingredient can be added to the chamber to prevent or avoid caking of the composition (e.g., rice powder, silicon dioxide, glidant etc.). When an ingredient is present in the chamber, the ingredient typically takes up about 90% or less, or about 80% or less, or about 75% or less, or about 70% or less, or about 65% or less, or about 50% or less of the total available volume of the chamber. For example and without limitation, about 2 grams of solid can be contained in an exemplary chamber, sized such that the about 2 grams of solid takes up about 60% of the total available volume of the chamber The chamber can include one or more side walls and one or more top walls attached to the one or more side walls. The chamber can also include an opening opposite the one or more top walls. In another aspect, the chamber can have at least two openings. At least part of any opening can be covered by a film, which can be any type of film known in the art. For example, the film can include at least one of a plastic film, a metal film, a foil film, a paper film, and a film containing a combination of the foregoing (e.g., a metalized plastic film). The film can be, for example, a bi-axially oriented film of polypropylene or metalized polypropylene. The film can provide a barrier to at least one of moisture and oxygen. The film can be made of a material that does not increase the actuation force (i.e., the force required to depress the chamber into the shell), for example, a material designed such that only a trivial amount of force is required to pierce and break the film when the film engages a cutting element. The film can cover a part of an opening, or it can cover an entire opening.

The one or more side walls of the chamber can include at least one to three continuous beads. The continuous beads can include an uppermost continuous bead, a middle continuous bead, and a lowermost continuous bead. Each of the at least one to three sets of continuous beads can extend along the entire exterior distance around the one or more side walls. A lowermost continuous bead can be a first distance from the opening, a middle continuous bead can be a second distance from the opening, and an uppermost continuous bead can be a third distance from the opening. The third distance can be greater than the second distance, which in turn can be greater than the first distance. Alternatively, the continuous beads can be replaced with continuous threads. In another aspect, the beads or threads are discontinuous or interrupted.

The one or more side walls of the chamber can be tapered so that the distance around the one or more side walls of the chamber is narrower near the opening opposite the top wall than at the top wall. The chamber can have one or more side walls with a lower portion and an upper portion. In one aspect, the width of the lower portion is greater than the width of the upper portion. The increase in width from the lower portion to the upper portion can be a smooth continuous taper or it can be stepped or discontinuous forming one or more platforms on the one or more side walls. In another aspect, described taper is disposed on one or more inner side wall of the chamber.

In another aspect, the width of the upper portion is greater than the width of the lower portion. The increase in width from the upper portion to the lower portion can be a smooth continuous taper or it can be stepped or discontinuous forming one or more platforms on the one or more side walls. In one aspect the difference in width between the upper portion and the lower portion is at least about 10 points or at least about 50 points. In another aspect, the difference in width between the upper portion and the lower portion is from at least about 1 to about 100 points. In another aspect, described taper is disposed on one or more inner side wall of the chamber.

The one or more side walls of the chamber can have one or more protrusions disposed therein to, for example, facilitate the flow of liquid in the chamber. The term "protrusion" can refer to, for example, any elevation, inversion, bump, bead, or thread in the side wall such that the movement of a liquid or particle in the chamber will be altered, diverted, or redirected. In one aspect, the at least one protrusion is disposed on one or more inner walls of the one or more side walls of the chamber. In another aspect, the protrusion may be disposed on a top or bottom wall of the chamber. In yet another aspect, the protrusion is continuous or discontinuous line. In another aspect, the protrusion may be of any suitable shape or pattern including linear, circular, rhomboid, square, random, or rectangular. In another aspect, the protrusion is at least 0.25 millimeters in height.

The chamber can be made with a pump seal disposed on the outer portion of the one or more side walls of the chamber. In one aspect the pump seal is disposed around the entire perimeter of the lower portion of the chamber. In another aspect, the chamber is made of two or more types of plastic that can be molded together. In a further aspect, one plastic can be rigid and a second plastic can be flexible (e.g., used for the pump seal). The pump seal can minimize or prevent, for example, the retention of liquid between the shell and chamber.

In one aspect the one or more side walls of the chamber are formed from a rigid substrate (e.g., PP (poly propylene), HDPE (high density polyethylene), metal or the like)). In another aspect, the pump seal is made of an elastic sealing material (e.g., all food safe elastomers including but not limited to food safe silicone). In this aspect, the pump seal substantially eliminates or minimizes any liquid retained between the shell and chamber. Alternatively, a flexible material (e.g., TPE, rubber band and the like) can be used in place of the pump seal.

In another aspect, the chamber can be multi-layered using different sealing materials. These sealing materials can be added at any suitable point in the manufacturing process (e.g., pre-mold or post-mold). In one aspect, a material used to make the chamber can absorb moisture (e.g., a desiccant). In another aspect, the material can prevent or reduce the adherence of ingredients in the chamber to the chamber walls (e.g., stainless steel, silicon, paper, and mica). Additional materials can be used to provide an improved moisture and/or oxygen barrier (e.g., polypropylene, metal, aluminum, and ethylene vinyl alcohol).

The chamber can be actuated (e.g., moved in any direction) and disposed inside a shell. In one aspect, the chamber is actuated with a force sufficient to dispose the chamber inside a shell. In another aspect, the force is sufficient to abrade, pierce, cut, or remove a film covering an opening in the chamber. In another aspect, the shell or chamber can provide resistance to actuation of the chamber into the shell to prevent, for example, accidental actuation of the chamber into the shell (e.g., before actuation is desired, for example, during transportation of storage).

The shell can include a shell base for engaging the opening of a container, for example, a beverage or cosmetics container. The shell base can engage the opening of the container, for example, to provide a leak resistant seal with the opening of the container. The leak resistant seal can be made tamper evident, for example, by including a tamper band in the shell base. The shell can also include a shell chimney disposed, for example, in the shell base for engaging with a chamber. In one aspect, there is substantially no space between the shell base and the shell chimney to, for example, minimizes retention of liquid between the shell base and the shell chimney.

The shell can include a shell basket disposed, for example, below the cutting element. In one aspect, the shell basket can be used for moving the cut film away from the chamber opening after it is pierced or cut by the cutting element. In another aspect, the shell basket protrudes below the shell base. In this aspect, for example, the shell basket may partially protrude into the container. In yet another aspect, the shell basket is substantially flush with the bottom of the shell chimney. This aspect may be advantageous in simplifying manufacture and molding of the cap device resulting in, for example, lower manufacturing costs. In another aspect, a shell basket that is substantially flush with the bottom of the shell base may facilitate the installation of a plug seal or TPE seal or the like (e.g., by compression molding), minimize leakage, and permit use of an unscrewing mold (e.g., to enhance thread consistency and profile.

After the chamber is actuated, it may be inserted into the shell such that the top of the chamber is flush or nearly flush with the top of the shell. In another aspect, the height of the chamber is elongated or increased to facilitate the removal of the chamber after, for example, actuation of the chamber. In this aspect, the height of the chamber with respect to the top of the shell after the chamber is actuated is sufficient to permit removal of the chamber from the shell using human hands. In another aspect, the height of the chamber with respect to the top of the shell after the chamber is actuated is at least about 1 cm.

In another aspect, a clip (e.g., handle, pull tab, projection or the like) can be attached to the top of the chamber in order to facilitate removal of the chamber from the shell. In this aspect, even if the top of the chamber is flush with or recessed below (e.g., 2 or more centimeters) the top of the shell after actuation of the chamber into the shell, the user can engage the clip to facilitate removal of the chamber in order to, for example, consume or use the product in the container or replace the chamber in the shell with a new chamber. In another aspect, the clip can be embedded in the top of the chamber in a groove such that the clip will not interfere with the normal operation of the chamber but can be accessed with human fingers. In this aspect, the clip can be lifted or pulled into a position where the clip can facilitate removal of the chamber from the shell. The clip can be made of any suitable material (e.g., TPE, plastic, metal etc.) and may be of any suitable shape (e.g., loop, circular, square, rectangular, rhomboid, triangular, etc.).

In another aspect, a separate chamber actuator can be provided. The chamber actuator can be adapted to engage with the chamber to assist the consumer in actuating the chamber into the shell. This aspect may be useful for consumers who would otherwise have difficulty applying the actuation force needed to actuate the chamber into the shell and pierce or cut the film.

In another aspect, the cap devices described herein can be adapted to be used with a container or a beverage making machine or device. For example, the replaceable chamber or shell can have threads disposed on the bottom or top portion adapted to engage with a container and also be adapted to be disposed in a commercial or consumer grade brewing or drink machine. When used with a commercial or consumer grade brewing or drink machine, a cutting element in the chamber or shell as described herein can pierce or cut the film and liquid can be provided by the brewing or drink machine. The liquid can be mixed with the composition in the chamber or shell and be deposited in a cup in the same manner as the brewing or drink machine is conventionally used. Alternatively, a cutting element in the brewing or drink machine can be used to pierce the film in the chamber or shell. In another aspect, a mechanism in the brewing or drink machine can pierce a film in the chamber or shell and shake or vibrate the chamber or shell to dispense the ingredients which are mixed with a liquid and dispensed into a cup or container to receive the finished beverage. In this aspect, chambers and shells containing compositions can be provided individually or in packages with multiple chamber and shells. The chambers and shells can be for single or multiple uses.

A cutting element can be associated with the shell, and can be, for example, disposed within the interior of the shell. The cutting element can be designed for at least one of piercing and cutting the film. Piercing, cutting, or piercing and cutting the film can be performed in such a manner that the cut film is displaced from the opening in the chamber and allows communication between the chamber and the shell.

The cutting element can include one or more edges. The one or more edges can be disposed at an angle with respect to the side walls of the shell. The angle can be, for example, a right angle, and acute angle, or an obtuse angle. The one or more edges may be of any suitable shape (point, square, triangle etc.) and any suitable degree of sharpness. The degree of sharpness can be adjusted, for example, to change the actuation force required to pierce or cut the film. The cutting element can include one or more of a point for piercing the film, a cutting mechanism for cutting the film, and a basket for moving the cut film away from the opening. One or more of the point and cutting mechanism can form all or part of the basket. The cutting element can include at least two arms which associate the cutting element with the shell. The angle between the at least two arms and the shell can be any suitable angle. In one aspect, the angle is from about 1 to about 90 degrees.

Alternatively, the cutting element can be associated with the chamber, and can be, for example, disposed within the interior of the chamber, for example, on a top wall, the middle, or on a lower portion of the chamber. The cutting element can be designed for at least one of piercing and cutting a film associated with, for example, an opening in the shell. Piercing, cutting, or piercing and cutting the film can be performed in such a manner that the cut film is displaced from an opening in the shell to allow communication between the shell and a container associated with the shell. In one aspect, the cutting element is disposed on a flexible top wall of the chamber. The cutting element can be actuated, for example, by applying a force to the top of the flexible chamber which pushes or actuated the cutting element in a downward manner toward the film.

The cutting element can include one or more sharp edges. The one or more sharp edges can be disposed at an angle with respect to the side walls of the shell. The angle can be, for example, a right angle, an acute angle, or an obtuse angle. The cutting element can include one or more of a point for piercing the film and a cutting mechanism for cutting the film. The cutting element can include at least two arms which associate the cutting element with an inner side wall of the shell.

The shell can also include at least three sets of locking beads on the one or more side walls. In another aspect, the shell includes at least three sets of locking beads on the one or more side walls. Each set of locking beads can include one or more locking beads, for example, a plurality of locking beads. The at least three sets of locking beads can include an uppermost set of locking beads, a middle set of locking beads, and a lowermost set of locking beads. The at least two sets of locking beads can include an upper set of locking beads and a lower set of locking beads. Each of the individual locking beads within a set of locking beads can be located at substantially the same vertical distance from the shell base.

For example, the uppermost set of locking beads can be disposed around the one or more side walls in such a manner that each of the beads in the uppermost set is approximately a first distance from the shell base. Similarly, each bead of the of middle set of locking beads can be disposed around the one or more side walls so that each of the beads in the middle set of beads is approximately a second distance from the shell base, and each bead of the of lowermost set of locking beads can be disposed around the one or more side walls so that each of the beads in the lowermost set of beads is approximately a third distance from the shell base cutting element. The first distance can be greater than the second distance, which in turn can be greater than the third distance.

With respect to the at least two sets of locking beads, the upper set of locking beads can be disposed around the one or more side walls in such a manner that each of the beads in the upper set is approximately a first distance from the shell base and each of the beads in the lower set is approximately a second distance from the shell base.

Each of the at least three sets of locking beads or the at least two sets of locking beads can be on the interior of the one or more side walls of the shell, for engaging with the continuous beads of the chamber. The one or more beads of each of the at least three sets of locking beads or the at least two sets of locking beads can have, for example, an interrupted design wherein there are spaces between the beads. Unexpectedly, the inventors have found that an interrupted design can allow for an acceptable fit with the continuous beads of the chamber without unacceptably increasing the stiffness of the shell. In one aspect, an unacceptable increase in the stiffness of the shell can give rise to manufacturing difficulties.

The locking beads can be of any size sufficient to engage the continuous beads of the chamber. The locking beads and continuous beads can provide a leak-resistant fit. Thus, the tightness of the fit between the locking beads and the continuous beads, which can be correlated to the actuation force required to depress the chamber, can provide an appropriate balance of ease of actuation and acceptable leak resistance. A tight fit between the locking beads and the continuous beads can be associated with a high degree of leak-resistance and a high actuation force. That is, while a tight fit provides high leak resistance, it also increases the force required to overcome the fit between the continuous beads and the locking beads when depressing the chamber. Thus, if the actuation force is too high, then a customer may have difficulty actuating the chamber. A loose fit between the locking beads and the continuous beads can be associated with a low degree of leak-resistance and a low actuation force, which can lead to both unacceptable leaks and to inadvertent actuation, for example, during shipping, storage, stocking, etc.

The inventors have unexpectedly found that the fit between the locking beads and the continuous beads can provide an actuation force of about 10 pounds to about 30 pounds, or about 20 pounds to about 30 pounds, or about 20 pounds to about 26 pounds and also provide both good leak resistance and acceptable ease of actuation. This force can be achieved, for example, by using locking beads and continuous beads that protrude from about 0.005 inches to about 0.015 inches, or about 0.008 inches to about 0.010 inches from the shell and chamber, respectively. For example, if the shell and/or chamber that has an inner thickness (i.e., the thickness of the shell and/or chamber in locations where no beads are present) of about 0.975 inches, then the outer thickness (i.e., the thickness of the shell and/or chamber plus the additional thickness provided by the beads) can be about 0.983 inches to about 0.985 inches, or about 0.985 inches, or about 0.984 inches, or about 0.983 inches. When the one or more side walls of the chamber are tapered as described above, then, for example, the lowermost set of locking beads can protrude about 0.008 inches from the shell, the middle set of locking beads can protrude 0.009 inches from the shell, and the uppermost set of locking beads can protrude, for example, 0.010 inches from the shell. Similarly, the uppermost continuous bead in the one or more walls of the chamber can have the smallest protrusion (e.g., 0.008 inches) from the one or more walls of the chamber, the middle continuous bead in the one or more walls of the chamber can have an intermediate protrusion (e.g., 0.009 inches) from the one or more walls of the chamber, and the lowermost continuous bead in the one or more walls of the chamber can have the greatest protrusion (e.g., 0.010 inches) from the one or more walls of the chamber.

In another aspect, the inventors have also unexpectedly found that two continuous beads and two sets of locking beads can provide both an acceptable leak resistance and actuation force.

In another aspect, threads can be used in place of the at least two and at least three sets of locking beads. In this aspect, shell threads can be disposed on the shell chimney continuously or discontinuously from the top portion of the shell chimney to the lower portion of the shell chimney. In another aspect, the chamber has one or more side walls, the one or more side walls having a top portion, a middle portion, and a lower portion. Chamber threads can be disposed on the middle portion. The chamber threads are adapted to sealably or rotatably engage with the shell threads (e.g., engage such that liquid retained between the chamber and the shell is substantially eliminated or minimized).

In one aspect, the chamber has chamber threads disposed on the one or more side walls. The chamber threads can, for example, be continuous threads or broken threads (e.g., FIG. 19, 406). This aspect also provides a shell with shell threads and optional beads disposed on the shell chimney. In this aspect, when the chamber threads engage with the shell threads, the chamber cannot be readily actuated into the shell. When the chamber is rotated with respect to the shell, for example beyond the length of the chamber threads and the shell threads, the chamber threads disengage from the shell threads. When the chamber threads disengage from the shell threads, the chamber is capable of being actuated into the shell. In one aspect, after the chamber threads disengage from the shell threads, the chamber can engage with the beads disposed on the shell to facilitate actuation of the chamber into the shell. In this aspect, for example, a dust cover is not needed because the chamber is in a "locked" position until the chamber is rotated and the chamber threads disengage from the shell threads.

In another aspect, the shell has locking slots (e.g., depressions, hole, gaps) adapted for receiving locking beads disposed, for example, on the chamber, a shell skirt, and a cutting element. This aspect also provides a chamber with locking beads and locking protrusions disposed on the side walls. Initially, the locking slots on the shell are not aligned with the locking protrusions on the chamber and the chamber cannot be readily actuated into the shell. In another aspect, the chamber can be rotated with respect to the shell in order to, for example, align the locking slots on the shell with the locking protrusions on the chamber. In this aspect, when the locking slots on the shell are aligned with the locking protrusions on the chamber, the chamber can be actuated and inserted into the shell wherein the cutting element can pierce the film. In another aspect, the chamber can be further rotated with respect to the shell until the locking slots are no longer aligned with the locking protrusions. In this aspect, the chamber is "locked" with respect to the shell and the chamber cannot readily be removed from the shell. In this aspect, a dust cover may not be needed since the chamber is initially "locked" until the locking slots on the shell are aligned with the locking beads on the chamber.

Figure 28A:
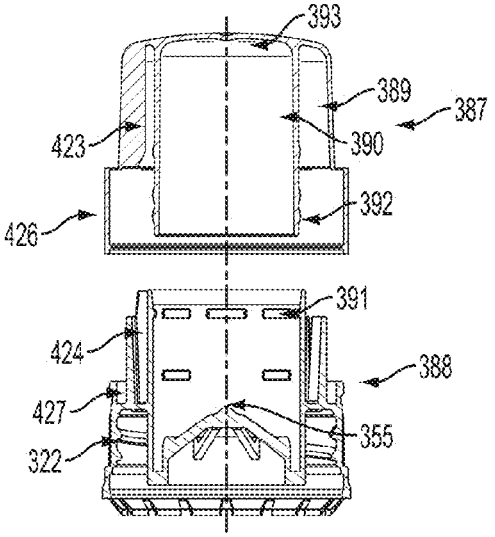
FIG. 28A is a side view of an exemplary cap device having a chamber with chamber locking protrusions and a tamper skirt, and a shell with shell gaps.
Figure 28B:
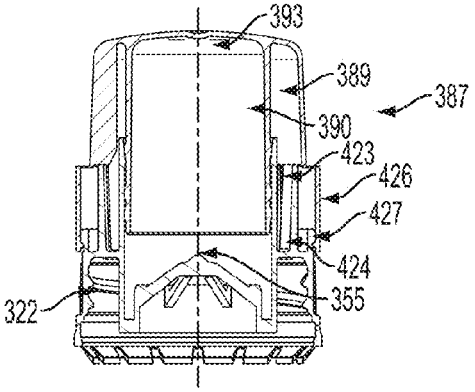
FIG. 28B is a side view of the cap device of FIG. 28A with an assembled chamber and shell.
Figure 28C:
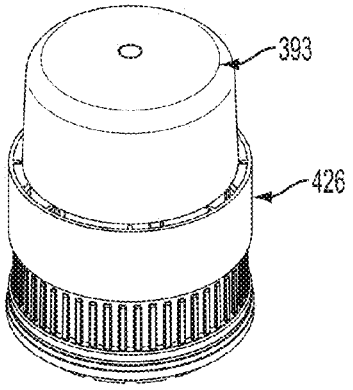
FIG. 28C is a side-top view of the cap device of FIG. 28A.

Alternatively, in this aspect, an optional tamper skirt can be provided and disposed around the lower portion of the chamber skirt (see, e.g., FIGS. 28A, 28B, and 28C). In this aspect, the tamper skirt can be removably attached to a tamper seat disposed around the shell. The tamper skirt can be removably attached to the tamper seat in a "locked" position until the association or connections between the tamper skirt and tamper seat are removed when the chamber is rotated. In this aspect, the tamper skirt can provide several functions. In one aspect, removing or "breaking" the association or connections between the tamper skirt and tamper seat indicates the cap device and container have been previously used or handled. This aspect provides a safety feature that helps a user avoid using the cap device and bottle if it has already been used or handled previously. In addition, the tamper skirt associated with or connected to the tamper seat helps prevent accidental rotation of the chamber and actuation of the chamber into the shell. For example, accidental actuation of the chamber into the shell during shipment could result in an unusable product (e.g., the product is no longer fresh because ingredients have been dispensed accidently). In this aspect, the dust cover is optional as, for example, the tamper skirt can perform a similar function.

A dust cover for covering the cap device can be provided over the chamber and shell. The dust cover can rest on the shell base. The dust cover can be connected to the shell base with a tamper-evident connection, such as tamper-evident connections known in the art which appear broken if the cap device has been tampered with. In one aspect, the dust cover is removably attached to the shell base or the top of the shell chimney. In another aspect, a plug seal is disposed between the dust cover and the shell base or the top of the shell or shell chimney. The plug seal can be made, for example, of any suitable elastic or flexible sealing component. In one aspect, the plug seal reduces or eliminates leakage of liquid, optionally provides an additional hermetic seal, and optionally retains carbonation.

The cap device can be designed to engage with any size opening in any type of container. For example, the cap device can engage with containers comprising glass, metal (e.g., aluminum), paper, for example. wax coated paper, plastic coated paper, etc., plastic, such as polyethylene, polyethylene terephthalate (PET), polystyrene, etc., or combinations thereof. The container can be any suitable bottle, glass, canteen and the like and may be disposable or reusable.

In one aspect, the shell is affixed to the container in a permanent or substantially permanent manner to minimize or prevent a consumer from removing the shell without actuating the chamber into the shell. For example, the shell can have inner locking beads disposed above or below threads disposed on the lower portion of the shell for permanently or substantially permanently affixing the shell to a container (e.g., during a capping process). In this aspect, the risk that the consumer will accidentally remove the cap device (and potentially dispose of the cap device) prior to consumption or use of the cap device and liquid in the container is minimized or eliminated. In this aspect, the consumer would also be encouraged to use the cap device as intended. In another aspect, the consumer would use a removable chamber and consumer or use the liquid in the container directly through top portion of shell and also minimize leakage from the lower half of the shell. This aspect will also discourage the consumer from using the exemplary cap devices associated with a container as a standard cap placed on a container (e.g., by removing the dust cover and disposing of the cap prior to consumption).

The cap device can be manufactured according to standard manufacturing means known in the art. For example, injection or extrusion molding can be used to manufacture the chamber, shell, and dust cover, etc. One or more ingredients can be added to the chamber or shell, at least one opening of which can then be at least partially covered with a film. The shell base can be engaged with an opening of a container. The order of these steps is not necessarily critical, for example, the shell base can be engaged with an opening of a container before the chamber is engaged with the shell.

In one aspect, a cap device can be used to add at least a portion of a composition to a container by actuating the chamber wherein at least a portion of the cutting element pierces the film and at least a portion of the composition is released into the container. In one aspect, at least 90% of the composition in the chamber is released into the container. In another aspect, the container contains a liquid (e.g., water, juice, soda, shampoo, cosmetics etc.). In yet another aspect, the container can be agitated after the composition is released into the container and liquid from the container can flow into the cap device (e.g., into the shell and chamber). In one aspect, the composition is contained in the shell. In another aspect, the composition is contained in the chamber. In a further aspect, the cutting element is disposed on the chamber (e.g., the top portion of the chamber or the bottom portion of the chamber). In a further aspect, the cutting element is disposed on the shell (e.g., in the shell base or in the shell basket). Any of the cap devices described herein can be used in the above described methods.

Aspects described herein facilitate the flow of the liquid in the shell and chamber resulting in removal of some or substantially all of the composition from the cap device. In another aspect, substantially all of the liquid is removed from the chamber after agitating the container. In yet another aspect, the container is agitated from at least two to at least twenty times. In one aspect the one or more protrusions of the one or more side walls of the chamber facilitate the flow of liquid in the chamber. In another aspect, there is substantially no liquid between the shell and the chamber after agitating the container.

In yet another aspect, the chamber is removed from the shell after agitating the container and can be replaced with another chamber containing, for example, the same or another composition. In a further aspect, the shell can be removed from the container after agitating the container and can be replaced with another shell containing, for example, the same or another composition. In another aspect, after agitating the container, the film covering an opening of the chamber or shell can be replaced or repaired and a composition can be added to the same chamber.

In another aspect, the chamber has a top opening and a bottom opening. The bottom opening can be covered by film. In this aspect, after the chamber is actuated into the shell and the cutting element pierces the film, the composition is released into a beverage in the container. The beverage can be consumed, for example, through the top opening in the chamber. Optionally, the top opening can also be covered by a film that can be removed by the user prior to consumption of a beverage in a container attached to the cap device. In another aspect, the dust cover can be elongated to accommodate the additional length of the chamber with a top opening. The top opening can be adapted to form a drinking spout to facilitate consumption of the beverage. In another aspect, consumption of the beverage through the top opening in the chamber can minimize undesirable leakage of the beverage, which can occur when the shell is removed from the container in order to consume the beverage. In yet another aspect, shell beads can be disposed the inner surface of the shell chimney for engaging with chamber beads disposed on the outer surface of the chamber.

Figure 22:
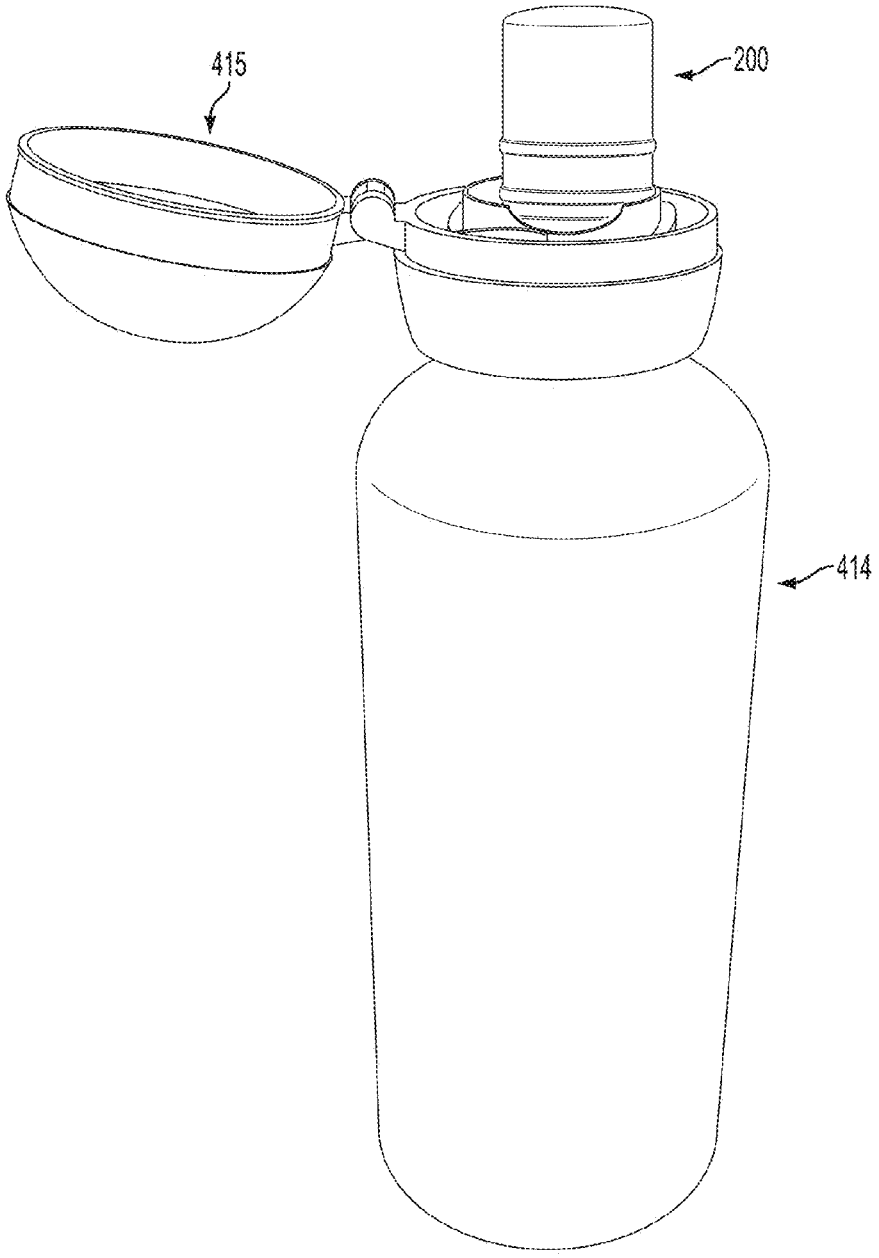
FIG. 22 depicts an exemplary cap device chamber associated with a resusable container.

In another aspect, the shell optionally does not have a shell base, and the shell chimney protrudes below a flange disposed around the shell chimney. Optional threads can be disposed on the outer surface of the shell chimney. The threads can engage to associate the shell with any suitable container (e.g., reusable water bottle, canteen, thermos etc.). In this aspect, the cap device can be used with any suitable container. In another aspect, the cap device can be manufactured and sold separately from a container and beverage such that a consumer can purchase cap devices separately or in multiple packaging and use the cap device with any container or resusable container having threads adapted to receive the chimney threads. In this aspect, no shell base is needed which can reduce the cost of molding and manufacturing the cap device. Optionally, a dust cover can be removably attached to the flange. Alternatively, the chamber and shell assembly can be used to dispense the composition to the reusable container and then removed. The cover or cap provided with the reusable container can then be used in typical operation with the resusable container (e.g., as shown in FIG. 22).

In yet another aspect, a cap device having a piercer and shell is provided. The shell can have an integrated chamber containing a composition and a top and bottom opening optionally covered or partially covered by a film. The piercer can have a top portion adapted to engage with a human finger or hand and a bottom portion comprising a cutting element which can optionally protrude from the top portion. The piercer can have beads disposed on the outer portion adapted to engage with corresponding beads in the inner surface of wall of the chamber integrated into the shell. The shell can have threads disposed on the inner surface or wall adapted to engage with corresponding threads on a container or bottle, optionally containing a liquid or beverage.

In this aspect, the piercer is located in the shell with the top portion of piercer substantially aligned with the top portion of shell. When the piercer is actuated and pushed downward into the chamber integrated in the shell, a film disposed over the bottom opening can be cut or partially cut; dispensing or releasing the composition into the container or bottle. In another aspect, the top portion of the piercer is removable, either completely separable from the piercer or in a replaceable fashion permitting the liquid or beverage to be consumed through the opening in the top portion. In yet another aspect, a film can be provided over the top opening and can be removed by the user prior to actuation of the piercer. In another aspect, the chamber can be added to or "snapped" into the shell or the shell can be added to or "snapped" onto the chamber (e.g., FIG. 24). In this aspect, protrusions disposed on the outer surface of the shell are adapted to retain the shell in the shell base after the shell is inserted into the shell base. Optionally, the shell containing the composition can be replaced for use with a reusable bottle or container.

Alternatively, a dust cover adapted to be placed over the piercer and chamber and removably attached to the shell base can be used to initially seal or partially seal the cap device and container assembly. In another aspect, the top portion of the chamber is open (e.g., not covered by a film) or is optionally covered with a film that can be removed by a user prior to use of the cap device. In this aspect, a pump seal (e.g., elastic sealing material such as all food safe elastomers including but not limited to food safe silicone) or other flexible material (e.g., TPE, rubber band and the like) can be disposed on or associated with the side walls of the piercer to maintain the freshness of the composition in the chamber and minimize or prevent leakage of the beverage or liquid.

Figure 25:
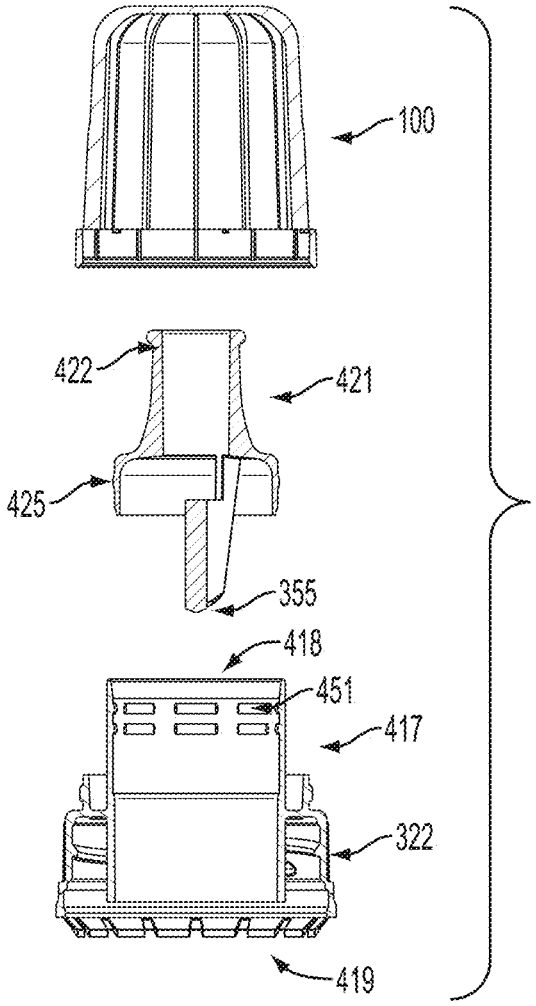
FIG. 25 is a side view of an exemplary cap device having a dust cover, a drink-through piercer with a cutting element, and a shell.

In another aspect, the piercer has a top portion with an opening through which the beverage or liquid can be consumed following actuation of the piercer into the shell (e.g., FIG. 25). In this aspect, the top portion of the piercer protrudes above the top portion of the shell. Optionally, a dust cover removably attached to the shell base can initially cover the piercer and shell. In yet another aspect, the chamber can be added to or "snapped" into the shell or the shell can be added to or "snapped" onto the chamber (e.g., FIG. 26). In this aspect, protrusions disposed on the outer surface of the shell are adapted to retain the shell in the shell base after the shell is inserted into the shell base. Optionally, the chamber, in this aspect can be replaced for use with a reusable bottle or container.

Further aspects provide a cap device having a chamber with a bottom opening covered or partially covered with a film for containing a composition. The chamber can have chamber beads and chamber threads disposed on the outer surface. The chamber threads can, for example, be continuous threads or broken threads (e.g., FIG. 27, 406). The cap device also includes a shell having a shell chimney and shell base. The inner surface of the shell chimney can have shell beads and shell threads. When the chimney threads and shell threads are engaged, the chamber beads and chamber threads are not aligned and the chamber cannot be actuated into the shell. In this aspect, the chamber and shell are "locked" with respect to each other (e.g., FIG. 27). Thus, during shipment of multiple containers or bottles in a package and/or when boxes with multiple containers or bottles are stacked on top of each other, the risk accidental or unintentional actuation of the chamber into the shell is minimized. Optionally, a tamper evidence band disposed, for example, on the top portion of the shell is provided. The tamper evidence band can interact, for example, with chamber beads (e.g., FIG. 27, 407). When the chamber is twisted or turned with respect to the shell, the chamber threads and shell threads are disengaged and the chamber beads can be aligned with the shell beads. In this position, the chamber can be actuated into the shell, the cutting element on the shell can remove or partially remove the film covering the bottom opening of the shell, and the composition can be released into the container or bottle and mix with the liquid or beverage contained therein. Optionally, a dust cover adapted to fit over the chamber and removably associate with the shell base can be provided.

Figure 29:
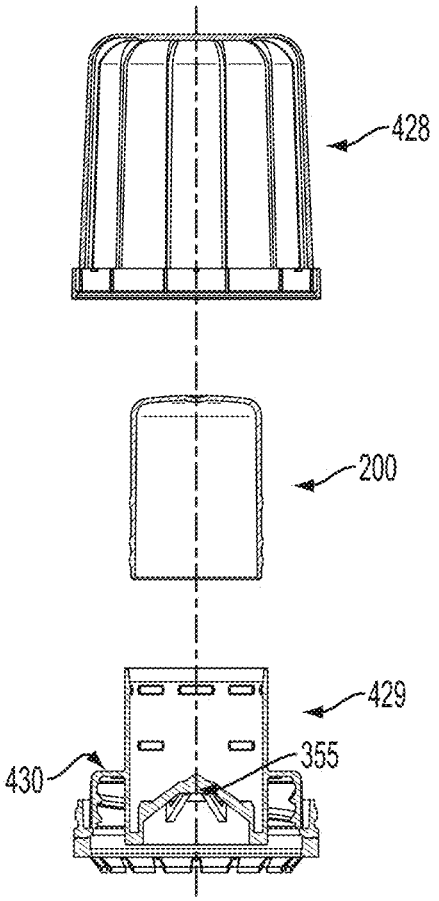
FIG. 29 is a side view of an exemplary cap device having an elongated dust cover, a chamber, and a shell with a dust cover seat on the lower portion of the shell base.

Other aspects provide a cap device with an elongated dust cover adapted to engage with a dust cover seat on a shell (see, e.g., FIG. 29). In this aspect, the dust cover seat is located on the lower portion of the shell base compared to other cap devices where the dust cover seat is located in the middle portion of the shell. In this aspect, the height of the shell base is smaller to accommodate the elongated dust cover and therefore the consumer less likely to grasp the shell base and remove it from the container. Thus, the consumer will be more likely to recognize the cap device for its intended use (e.g., dispensing ingredients into a container prior to consumption of a beverage).

Further aspects provide a chamber with structural features adapted to engage with the shell on the outside of the shell chimney (see, e.g., FIGS. 30-33). In these aspects, the structural features include beads or threads having any suitable shape (e.g., concave, convex). The structural features are provided, for example, on an skirt disposed on the outer surface of the chamber and also on the outer surface of the shell. Any suitable combination of structural features can be provided (e.g., beads on the chamber and shell, beads on the chamber and threads on the shell, threads on the chamber and beads on the shell, threads on the chamber and shell). These outer structural features can also be described with inner structural features described herein (e.g., beads or threads on the inner surface of the shell chimney).

EXAMPLES

Non-limiting examples are now provided with reference to the figures, where like numbers represent like elements.

FIG. 1 shows an exemplary dust cover 100, an exemplary chamber 200 and an exemplary shell 300. In FIG. 1 the dust cover 100, chamber 200, and shell 300 are disassembled, and can be applied to container 500, which can be, for example, a plastic, metal, or glass bottle, thermos, canteen and the like.

Figure 2:
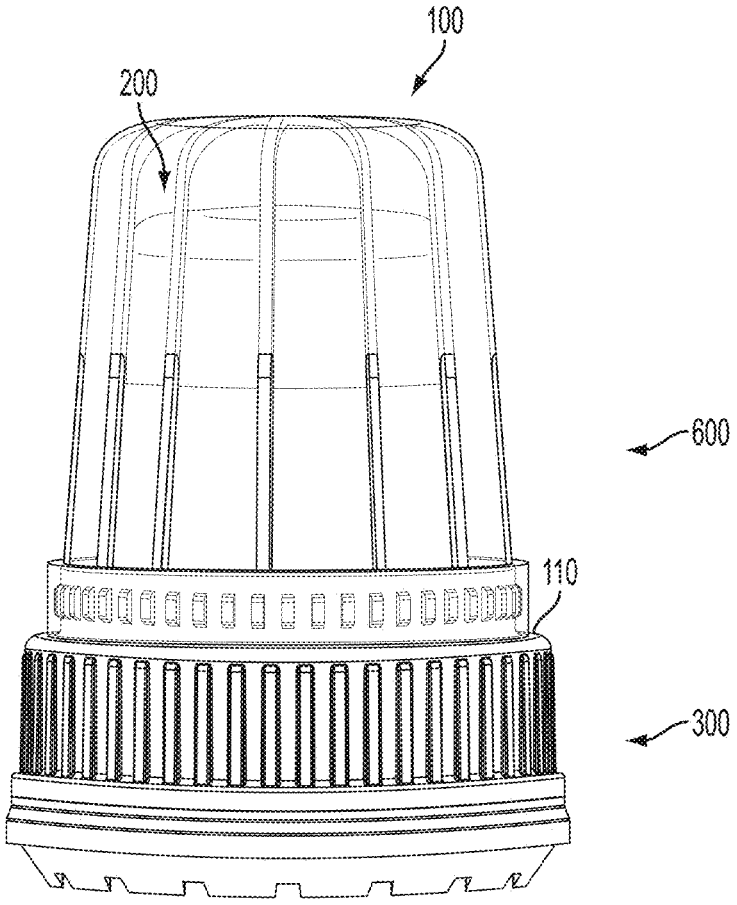
FIG. 2 is a side view of an exemplary assembled cap device before opening.

FIG. 2 shows an exemplary assembled cap device 600 prior to actuation. In FIG. 2, the dust cover 100 is attached to the base of cap shell 300 by a tamper-evident connection 110. In use, a consumer can twist the dust cover, break the tamper-evident connection 110, and access the chamber 200.

Figure 3A:
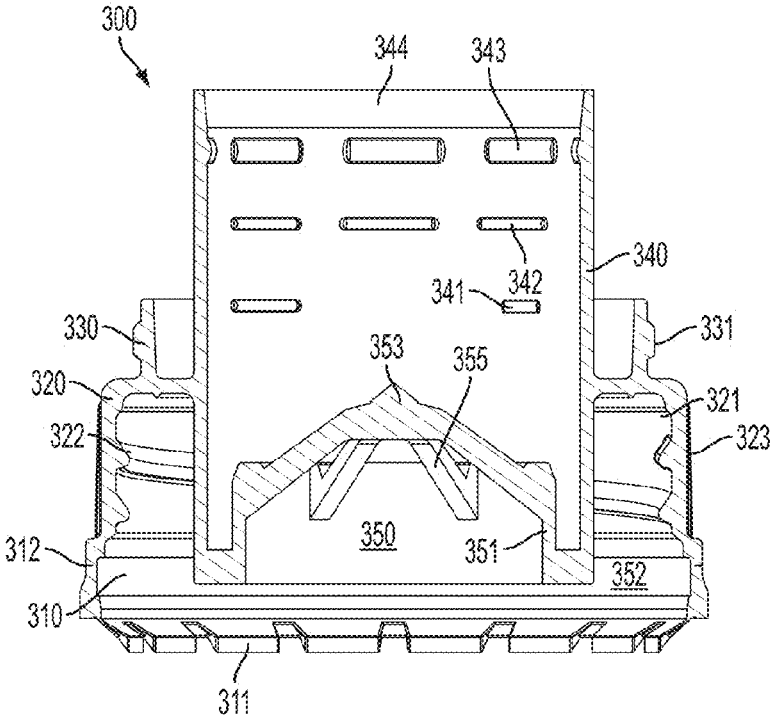
FIG. 3A is a cross-sectional side view of an exemplary cap shell.
Figure 3B:
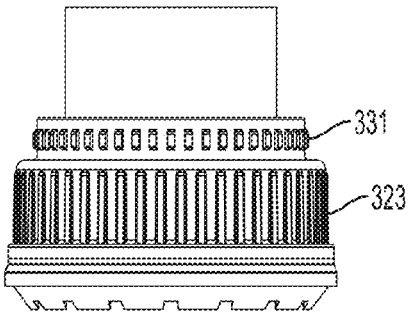
FIG. 3B is a side view of an exemplary cap shell.

FIG. 3A shows a cross-section of an exemplary shell 300. Tabs 311 at the bottom of the cap shell 300 fold underneath the container 500 (FIG. 1), allowing a tamper band 310 to engage the container 500 and keep the cap device in place. Because the tabs 311 will show evidence of tampering if they are removed, the tabs 311 can provide a consumer confidence that the contents of the container 500 (FIG. 1), for example, a bottle, were not tampered with so long as the tamper band 310 is in place. When a consumer twists the shell 300, tamper lead bands 312 can break, leaving the tamper band 310 on the bottle but allowing the shell 300 to be removed by unscrewing threads 322 located on the inside of the shell base 320 from complementary threads in the container 500 (not shown). Vertical ribs 323 located on the outside of the shell base 320 facilitate a consumer's grip on the shell base 320, thus making it easier for the consumer to remove the shell 300. FIG. 3B shows an alternate view of exemplary shell 300.

Tamper band support 330 can support tamper band 310 and provide a location for dust cover 100 (FIG. 1) to rest. In FIGS. 3A and 3B, the tamper band support 330 has vertical ribs 331 for enabling the dust cover tamper band 110 to engage the shell 300.

A cutting element 355 can be associated with shell 300, and in FIG. 3A, is located inside the shell 300. The cutting element of FIG. 3A includes a point 353, which forms part of a basket 351. When the chamber 200 (not shown) is actuated, the point 353 can pierce a film that covers an opening in a chamber 200 (not shown) and the basket 351 spreads the film out of the way of the opening in the chamber 200 (not shown) so that the interior of the chamber 200 (not shown) can communicate with the container 500 (FIG. 1).

The shell can also include a chimney 340, which is depicted in FIG. 3A as being cylindrical but which can be of any appropriate shape. The chimney 340 can include a chimney opening 344 that slopes outward for facilitating insertion of the chamber 200 (not shown) into the chimney 340. A friction fit with the chamber 200 (not shown) can be facilitated by three sets of locking beads, 341, 342, and 343. In this aspect, each set of locking beads in FIG. 3A is interrupted, with spaces between the one or more beads of each set. The uppermost set of locking beads 343 can retain the chamber 200 (not shown) in the shell 300 for shipping. The middle set of locking beads 342 can prevent inadvertent actuation and hold the chamber in place before actuation. The lowermost set of locking beads 341 can control the actuation force.

In FIG. 3A, a crush bead, 321, which may be any acceptable height, for example, 0.012 inches, is disposed on the shell base 320. The crush bead can be used to seal the shell 300 to the opening of a container 500 (not shown), such as a glass container 500 (not shown), for example, by providing a crush seal between the shell 300 and the container 500.

Figure 4:
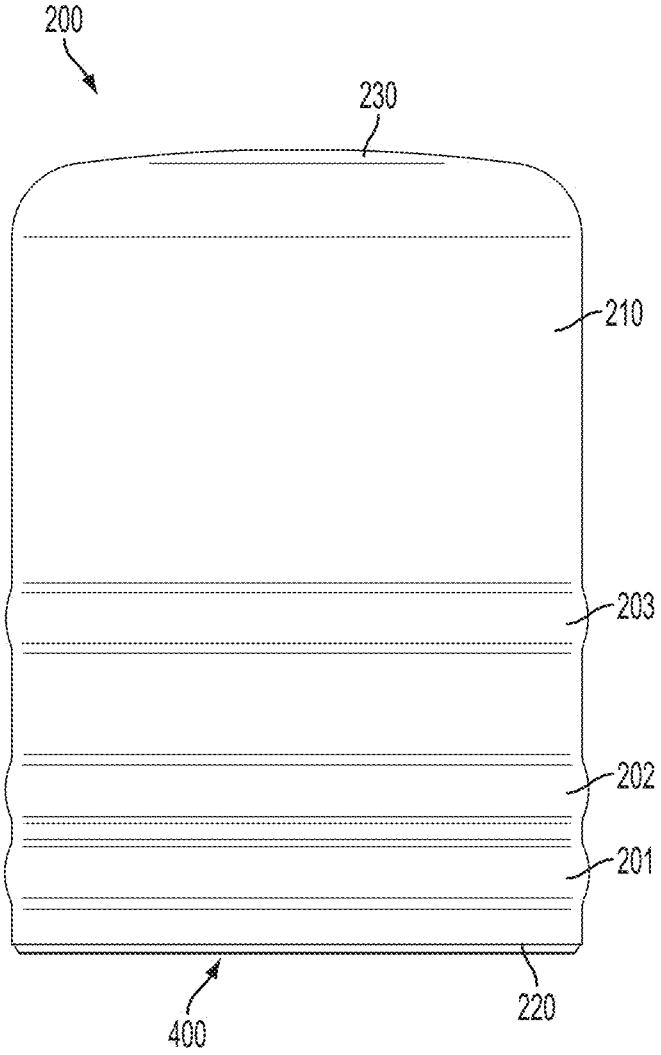
FIG. 4 is a side view of an exemplary chamber.

FIG. 4 depicts an exemplary chamber 200. Note that while the chamber 200 in FIG. 4 is generally cylindrical in shape, other shapes may also be used. The chamber includes side wall 210. Note that while in FIG. 4 there is only one side wall 210, which is configured in a generally cylindrical shape, it is important to recognize that there may be additional side walls which can be configured in different shapes. A top wall 230 is affixed to the side wall 210, and opening 220 is opposite the top wall 230. As with the side wall 210, more than one top wall 230 may be present, and the top wall or walls may be configured in different shapes. A film 400 covers opening 220, thus containing the contents of the chamber 200.

Side wall 210 includes three continuous beads 201, 202, and 203 for engaging with the three sets of locking beads 341, 342, and 343 in the shell 300 (not shown).

Figure 5A:
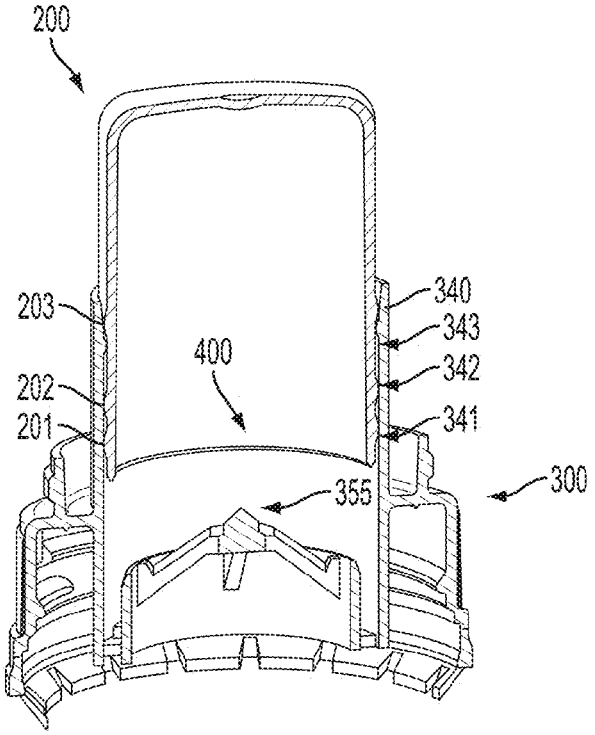
FIG. 5A is a cross-sectional side view of an exemplary shell and chamber with continuous and interrupted beads prior to actuation.
Figure 5B:
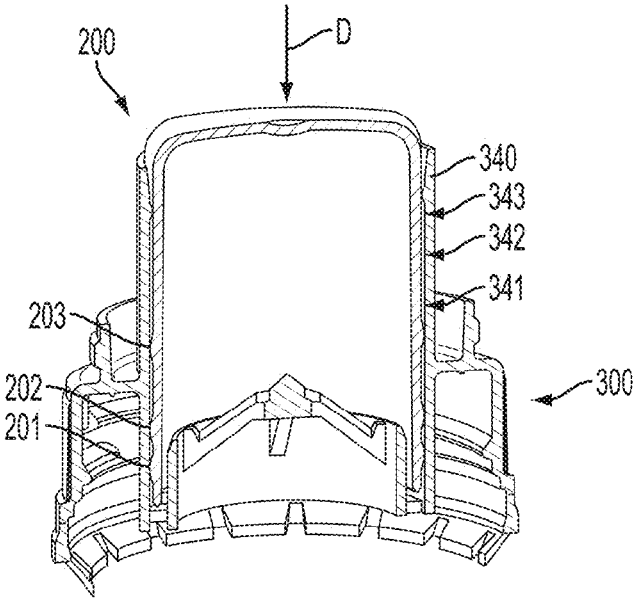
FIG. 5B is a cross-sectional side view of an exemplary shell and chamber with continuous and interrupted beads after actuation.

FIGS. 5A and 5B show an exemplary chamber 200 and shell 300 before (5*a*) and after (5*b*) actuation. In FIG. 5A, the sets of locking beads 341, 342, and 343 are engaged with continuous beads 201, 202, and 203 to prevent the chamber 200 from moving inadvertently prior to actuation. The three sets of locking beads 341, 342, and 343 and the three continuous beads 201, 202, and 203 also prevent the contents of a container 500 (not shown) from spilling. After actuation by pressing on the chamber 200 to move the chamber 200 in direction D, the three sets of locking beads 341, 342, and 343 become disengaged from the three continuous beads 201, 202, and 203. When the chamber 200 is fully actuated, the lowermost set of lock beads 341 engages with the uppermost continuous bead 203 to prevent the chamber 200 from becoming disengaged with the shell 300 by moving in a direction opposite to direction D.

After actuation of the chamber, the film 400 can be pierced with the cutting element 355 and at least part of a composition within chamber 200 can be added to the container 500 (not shown). The container 500 (not shown) with the actuated cap device can be agitated, for example by shaking, to ensure that at least 50%, at least 75%, at least 85%, at least 95%, essentially all, or all of the contents of the chamber 200 are added to the container 500. The cap shell 300 can then be removed from the opening in the container 500 (not shown) and the contents of the container 500, which includes at least part of the composition formerly within the chamber 200 and the liquid originally in the container 500 to be used, for example, drunk.

Any type of ingredient, including one or more of a solid, liquid, and a gaseous ingredient, may be contained within the chamber 200 or any of chamber or shell described herein. As one example, raw ingredients, such as those which have not been exposed to a temperature of more than 117° F. and thus contain active natural enzymes which can be killed by exposure to such temperatures, can be included. Phytonutrients, such as bioactive compounds from fruits and vegetables can also be included. Freeze dried (lyophilized) fruit, vegetable, plant, or animal materials can be included. Organic materials, such as materials derived from plants grown without the use of one or more of pesticides, herbicides, synthetic fertilizers, genetic modification, and harmful chemicals can be included. Exemplary components of a composition to be contained within the chamber 200 include camu camu berry, manoic root (manihot utilissima), acerola berry, amla berry, buckwheet berry sprouts, blueberry, raspberry, cranberry, cherry, rose hips, lemon peel, black pepper, algae (e.g. spirulina, klamath, chlorella, dunaliella, kelp, wakame, kombu, bladderwrack, dulse, and laver), millet sprouts, quinoa sprouts, broccoli sprouts, apple, green papaya, enzymes (e.g. amylase, cellulase, lipase, protease), mushrooms (e.g., reishi, shiitake, maitake, agraricus, cordyceps), astragalus root, eleuthero root, lycium (goji) berry, angelica sinensis root, schizandara berry, bai-zhu atractylodes rhizome, fo-ti root, paeonia lactiflor root, rehmannia root, codonopsis root, licorice (anise) root, jujube fruit, jojoba berry, poria, ginger, ginger rhizome, tangerine peel, polygala root, ligusticum wallichii rhizome, wheat grass, barley grass, oat grass, alfalfa grass, spinach leaf, parsley leaf, kale leaf, collard leaf, nettle leaf, red clover flower, skullcap flower, skullcap leaf, burdock root, ginkgo leaf, yellow dock root, dandelion leaf, rosemary leaf, clove bud, sage leaf, natural vitamin E (e.g., from sunflower), chia seed, extracts of any of the foregoing, lyophilized forms of any of the foregoing, and combinations of any of the foregoing.

Figure 6:
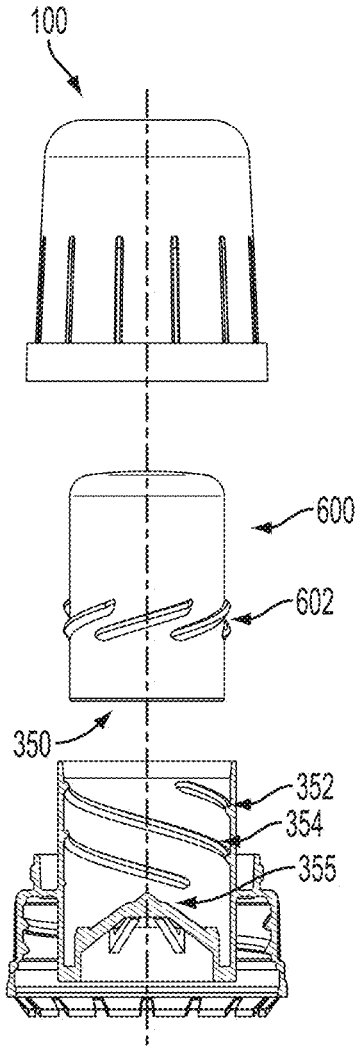
FIG. 6 is a side view of an exemplary cap device having a dust cover, chamber with middle thread, and shell with thread.

FIG. 6 shows exemplary dust cover 100, threaded chamber 600, and shell 352. In this example, threaded chamber 600 has chamber threads 603 disposed on the outer wall of the middle portion of threaded chamber 600. Shell 352 has shell threads 354 disposed on the inner wall from the lower portion to the top portion of shell 352. In operation, when discontinuous threads 602 of threaded chamber 600 rotatably engage with the discontinuous threads 354 of shell 352, threaded chamber 600 is actuated into shell 352, and cutting element 355 pierces the film covering the bottom opening 350 of threaded chamber 600.

Figure 7:
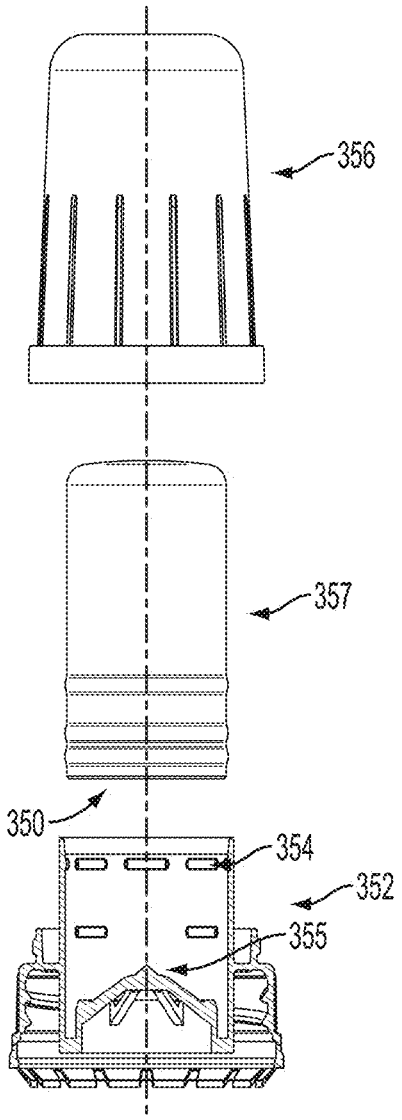
FIG. 7 is a side view of an exemplary cap device having an elongated dust cover, elongated chamber with continuous beads, and shell with interrupted beads.

FIG. 7 shows exemplary elongated dust cover 356, elongated chamber 357, and shell 352. In this example, the height of elongated chamber 357 is sufficient to permit elongated chamber 357 to be removed with human hands after actuation of elongated chamber 357 into shell 352. In this example, the height of elongated dust cover 356 is sufficient to accommodate the height of elongated chamber 357.

Figure 8:
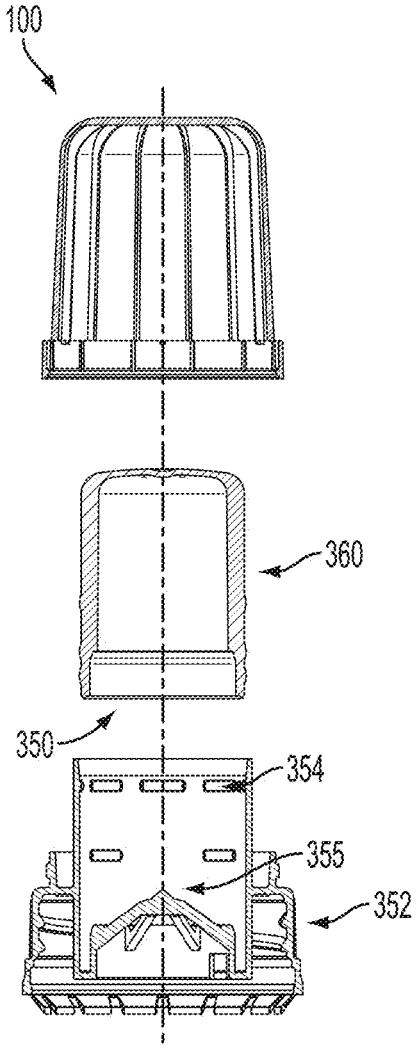
FIG. 8 is a side view of an exemplary cap device having a dust cover, chamber with tapered platforms, and a shell.

FIG. 8 shows exemplary dust cover 100, upward tapered chamber 360, and shell 352. In this example, the lower portion of upward tapered chamber 360 is wider than the middle portion of upward tapered chamber 360. In this example, the upward taper is formed in a series of platforms of steps of increasing width. Alternatively, the upward taper can comprise a smooth taper of increasing width. In operation, the upward taper minimizes the space between upward tapered chamber 360 and shell 352 and minimize retention of liquid between upward tapered chamber 360 and shell 352 after actuation of upward tapered chamber 360 into shell 352 and agitation of container 500 (not shown).

Figure 9:
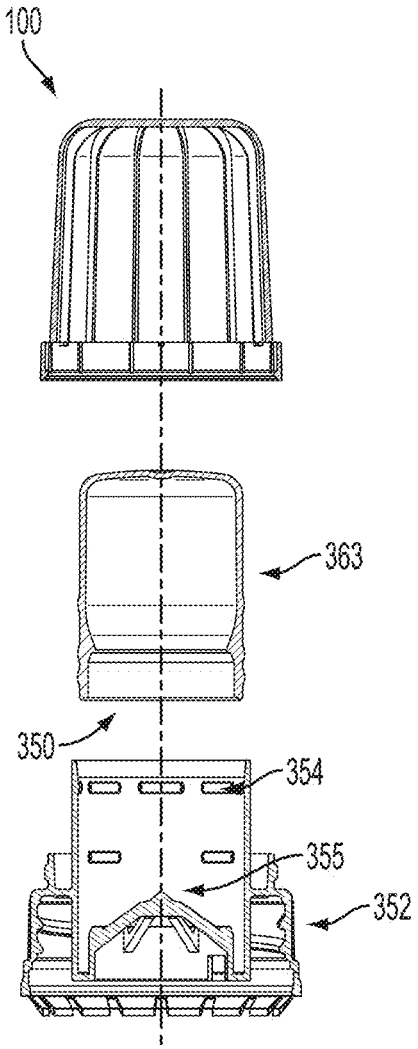
FIG. 9 is a side view of an exemplary cap device having a dust cover, chamber with alternative tapered platforms, and a shell.

FIG. 9 shows exemplary dust cover 100, downward tapered chamber 363, and shell 352. In this example, the downward taper is formed in a series of platforms of steps of decreasing width. Alternatively, the downward taper can comprise a smooth taper of decreasing width. In this example, the downward taper of downward tapered chamber 363 minimizes the retention of liquid on downward tapered chamber 363 after actuation of downward chamber 363 into shell 352 and agitation of container 500 (not shown).

Figure 10:
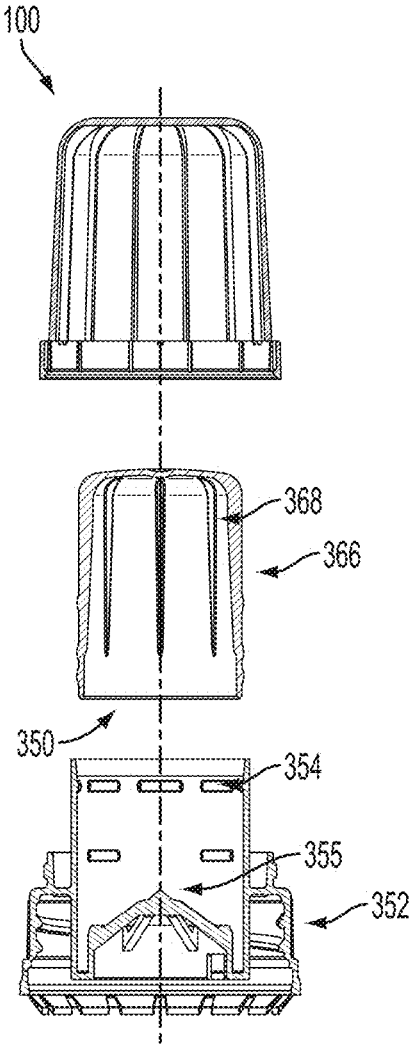
FIG. 10 is a side view of an exemplary cap device having a dust cover, chamber with protrusions, and a shell.

FIG. 10 shows exemplary dust cover 100, lined chamber 366, and shell 352. In this example, protrusions 368 on the inner wall of lined chamber 366 facilitate the flow of liquid into lined chamber 366 after actuation of lined chamber 366 into shell 352 and agitation of container 500 (not shown). In operation, protrusions 368 facilitate substantially complete removal of the composition from lined chamber 366 and minimize the retention of liquid in lined chamber 366 or shell 352 after actuation of chamber 366 into shell 352 and agitation of container 500.

Figure 11A:
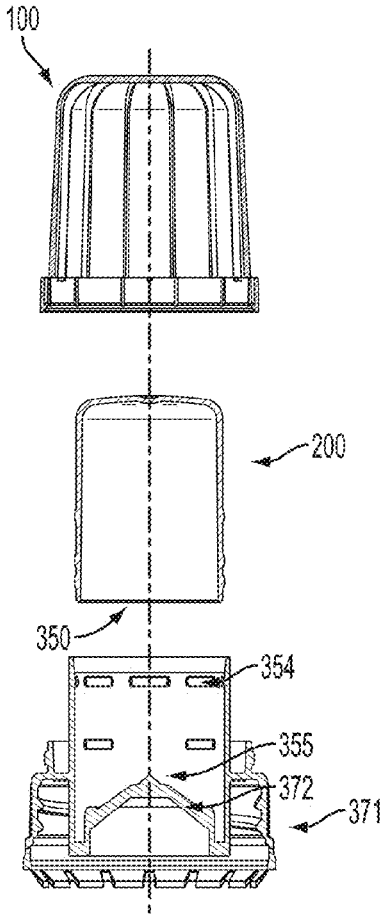
FIG. 11A is a side view of an exemplary cap device having a dust cover, chamber, and a shell with a two-arm cutting element.
Figure 11B:
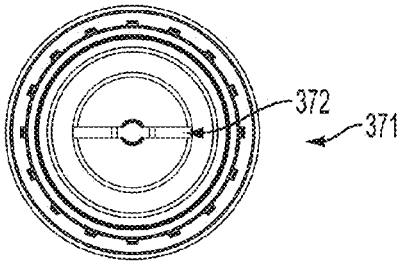
FIG. 11B is a bottom view of the shell with a two-arm cutting element.

FIG. 11A shows exemplary dust cover 100, chamber 200, piercer shell 371, and 2-arm piercer 372. In this example, 2-arm piercer 372 has two arms connecting cutting element 355 to shell 371. In operation, cutting element 355 supported by 2-arm piercer 372 cuts a film covering the bottom opening 350 of chamber 200 (not shown). After a composition is released into container 500 (not shown) and container 500 (not shown) is agitated, 2-arm piercer 372 facilitates the flow of liquid into the chamber 200 because additional piercer arms are not present to impede the flow of liquid. In addition, the composition is not impeded by the presence of additional piercer arms and can more readily be removed from chamber 370 (not shown). FIG. 11B shows a bottom view of shell 371 and 2-arm piercer 372.

Figure 12A:
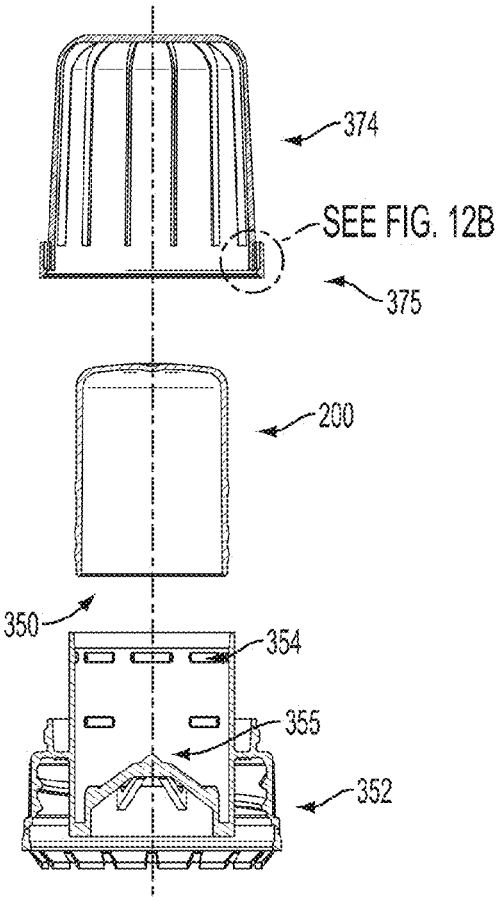
FIG. 12A is a side view of a cap device having an exemplary reusable dust cover with a plug seal, a chamber, and a shell.
Figure 12B:
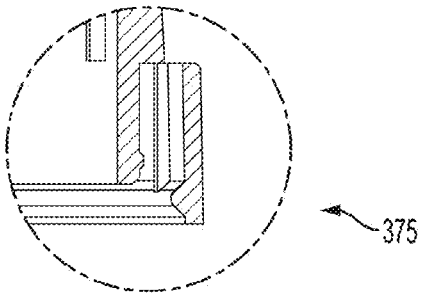
FIG. 12B is a detail view of the reusable dust cover with a plug seal associated with the shell.

FIG. 12A shows exemplary reusable dust cover 374 with plug seal 375, chamber 200, and shell 352. In operation dust cover 374 can be removably attached to shell 352. Plug seal 375 is disposed at the bottom portion of dust cover 374 to prevent or minimize leakage when dust cover 374 is reattached to shell 352. FIG. 12B shows a detailed view of plug seal 375.

Figure 13:
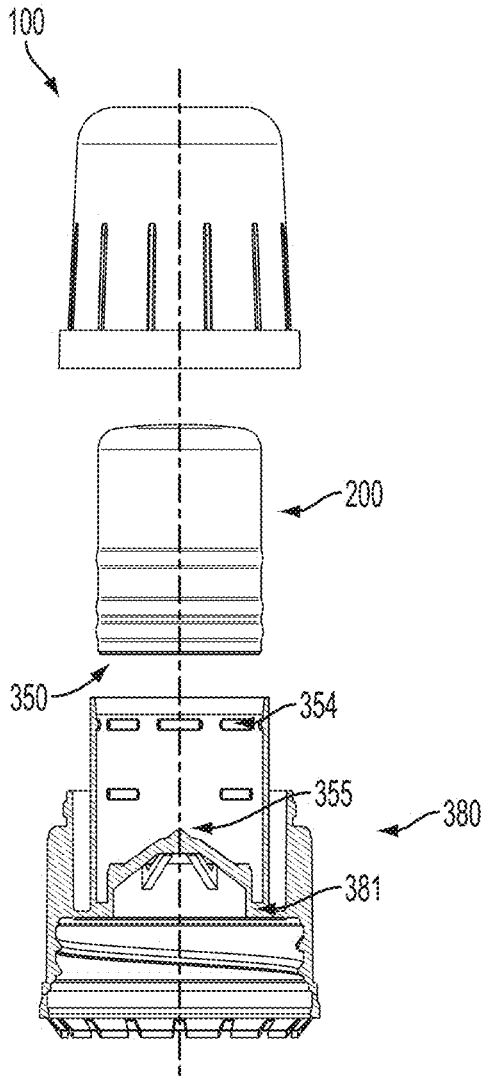
FIG. 13 is a side view of an exemplary cap device having a dust cover, chamber, and shell with a shell basket flush with the bottom of a shell chimney.

FIG. 13 shows exemplary dust cover 100, chamber 200, shell 380, and shell basket 381. In this example, shell basket 381 does not protrude below shell 380. In one aspect, the lower portion of shell basket 381 is substantially flush with the lower portion of shell 380.

Figure 14A:
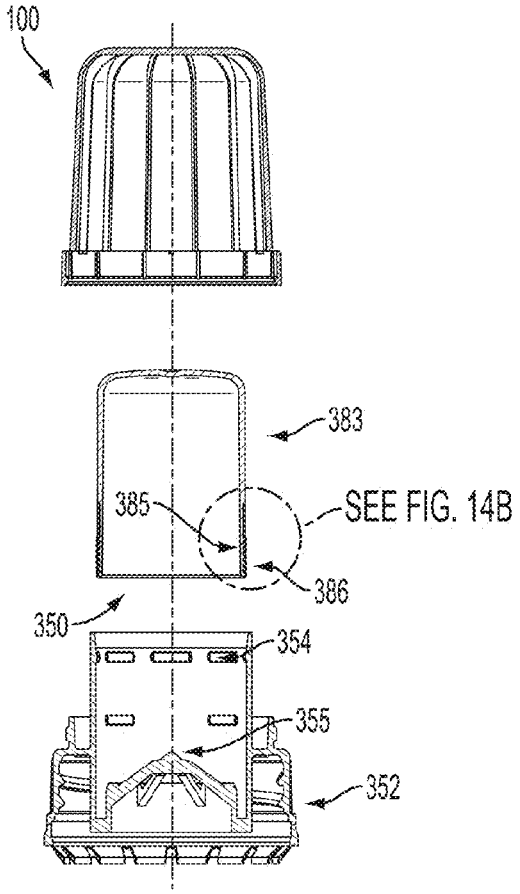
FIG. 14A is a side view of an exemplary cap device having a dust cover, a chamber with a pump seal, and shell.
Figure 14B:
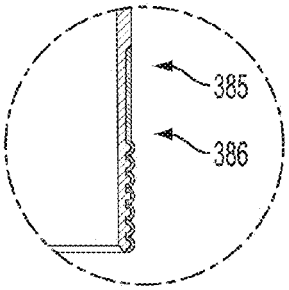
FIG. 14B is a detail view of the pump seal portion of the chamber depicted in FIG. 14A.

FIG. 14A shows an exemplary dust cover 100, chamber with seal 383, and shell 352. In this example, chamber with seal 383 has a rigid plastic portion 385 overmolded with an elastic sealing component 386. In this example, elastic sealing component 386 prevents or minimizes the retention of liquid between chamber with seal 383 and shell 352 after actuation of chamber with seal 383 into shell 352 and agitation of container 500 (not shown). FIG. 14B shows a detailed view of rigid plastic portion 385 and elastic sealing component 386.

Figure 15A:
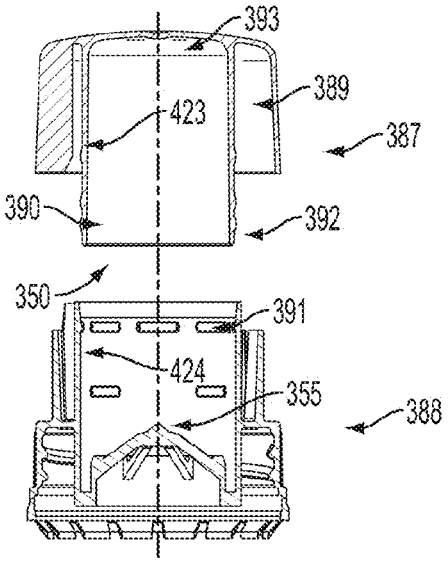
FIG. 15A is a side view of an exemplary cap device with a chamber having locking protrusions and a shell with shell gaps.

FIG. 15A shows an exemplary chamber 387 and shell 388. Chamber 387 has an outer portion 389 and inner portion 390 and optional opening 393. Opening 393 can optionally be covered with a film or a replaceable covering. Chamber 387 has circular beads 392 disposed on inner portion 390. Shell 388 has shell beads 391 for engaging with circular beads 392. Chamber locking protrusions 423 are provided for engaging with shell gaps 424.

Figure 15B:
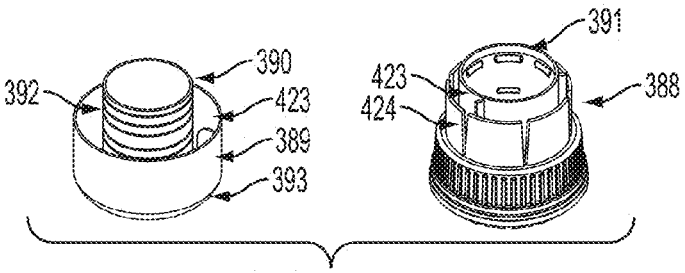
FIG. 15B is an alternative view of the chamber and shell of FIG. 15A.

FIG. 15B shows alternate view of chamber 387 and shell 388. In this figure, beads 392 are shown disposed on inner portion 390 of chamber 387. In operation, chamber 387 is inserted into shell 388 and beads 392 engage with shell beads 391 and chamber locking protrusions 423 are actuated into shell gaps 424. In this example, chamber 387 is actuated by rotating or twisting chamber 387 into shell 388 until chamber locking protrusions 423 lock into the shell gaps and chamber 387 cannot rotate with respect to shell 388.

Figure 15C:
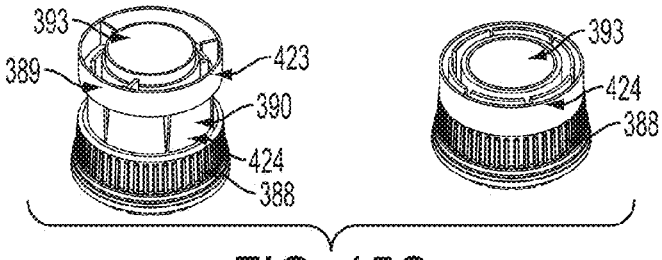
FIG. 15C is an open top view of the cap device depicted in FIG. 15A showing the chamber associated with the shell in an unactuated and actuated view.

FIG. 15C illustrates chamber 387 disposed in shell 388. In operation, beads 392 (not shown) are engaged with shell beads 391 (not shown) and outer portion 389 of chamber 387 is twisted wherein chamber 387 is actuated into shell 388 when, for example, chamber locking protrusions 423 are actuated into shell gaps 424. Cutting element 355 pierces or cuts a film disposed on the bottom opening of chamber 387 allowing a composition contained in chamber 387 to be released into container 500 (not shown) and mix with a liquid in container 500. In this example, the liquid can be consumed through opening 393 in chamber 387. In this example, no dust cover is used.

Figure 16A:
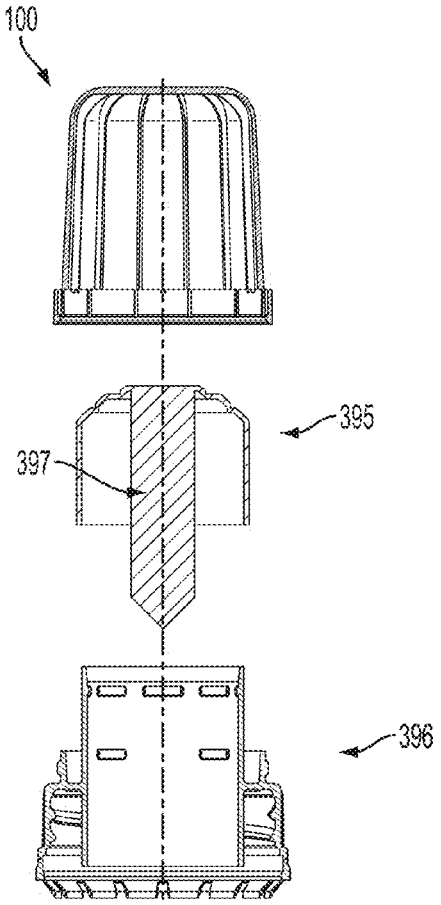
FIG. 16A is a side view of an exemplary cap device having a dust cover, chamber with cutting element disposed on the top wall, and a shell with a foil disposed on a bottom opening.
Figure 16B:
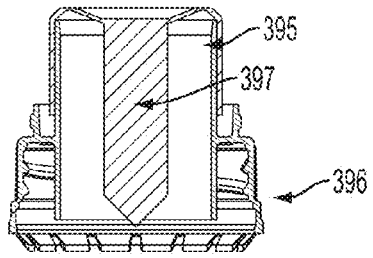
FIG. 16B is a side view of the cap device of FIG. 16A showing an actuated chamber with cutting element in the shell.

FIG. 16A shows an exemplary dust cover 100, top piercer chamber 395, and shell 396. Top piercer chamber 395 has a piercer 397 disposed on the top wall of top piercer chamber 395. Shell 396 has a film covering the bottom opening of shell 396 (not shown). In operation, when top piercer chamber 395 is actuated, piercer 397 pierces or cuts the film covering the bottom opening of shell 396 and a composition contained, for example, in shell 396 can be released into container 500 (not shown). FIG. 16B shows top piercer chamber 395 partially actuated into shell 396 just prior to piercer 397 piercing or cutting the film covering the bottom opening of shell 396 (not shown).

Figure 17:
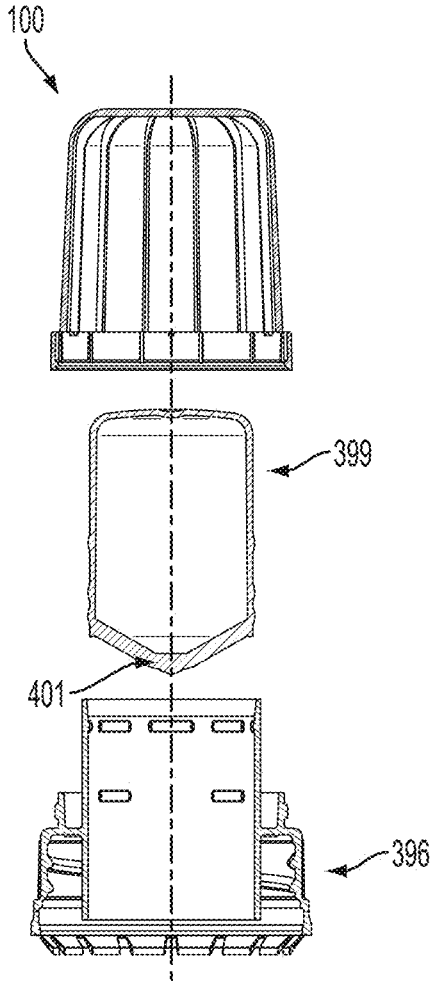
FIG. 17 is a side view of an exemplary cap device having a dust cover, a chamber with cutting element disposed on the lower portion, and a shell with a foil disposed on a bottom opening.

FIG. 17 shows an exemplary dust cover 100, bottom piercer chamber 399, and shell 396. In this example, bottom piercer chamber 399 has piercer 401 disposed on the bottom of bottom piercer chamber 399. In operation, bottom piercer chamber 399 is actuated into shell 396, piercer 401 pierces or cuts the film covering the bottom opening of shell 396 (not shown) and a composition contained, for example, in shell can be released into container 500 (not shown).

Figure 18:
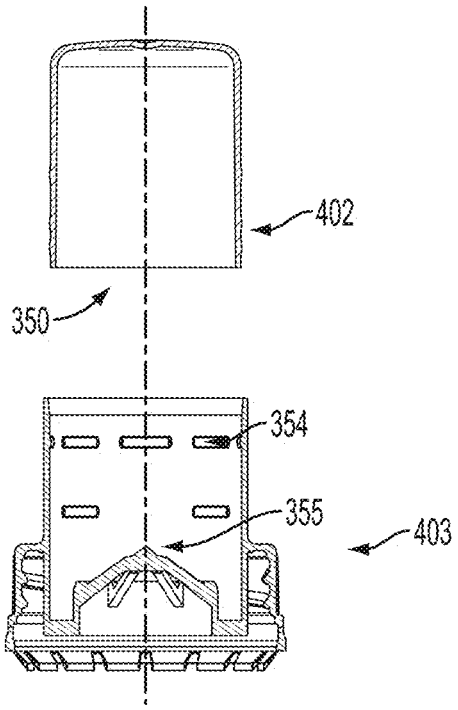
FIG. 18 is a side view of an exemplary cap device having an enlarged width chamber, and a shell with an enlarged width chimney.

FIG. 18 shows an exemplary double-width chamber 402 and enlarged shell 403. In this example, the capacity of double-width chamber 402 is increased by doubling the width of double-width chamber 402 compared to, for example, chamber 200. Enlarged shell 403 is adapted to be of a suitable width to receive double-width chamber 402. In this example, a larger volume of composition can be used in double-width chamber 402 compared to, for example, chamber 200.

Figure 19:
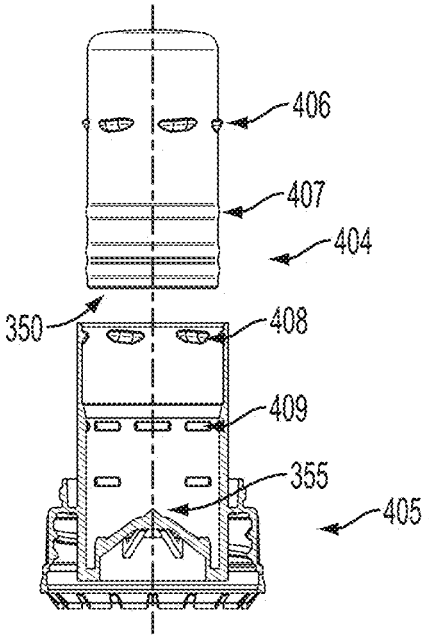
FIG. 19 is a side view of an exemplary cap device having a chamber with threads and locking beads and a shell with threads and locking beads.

FIG. 19 shows an exemplary chamber 404 and shell 405. Chamber 404 has chamber threads 406 and chamber beads 407. Shell 405 has shell threads 408 and shell beads 409. In operation, chamber threads 406 and shell threads 408 are aligned such that chamber threads 406 can fit in between shell threads 408 and chamber 404 can be actuated into shell 405. After chamber 404 is actuated into shell 405, chamber 404 can be rotated such that chamber threads 406 are no longer aligned with shell threads 408 and chamber 404 cannot be readily removed unless chamber threads 406 and shell threads 408 are realigned.

Figure 20:
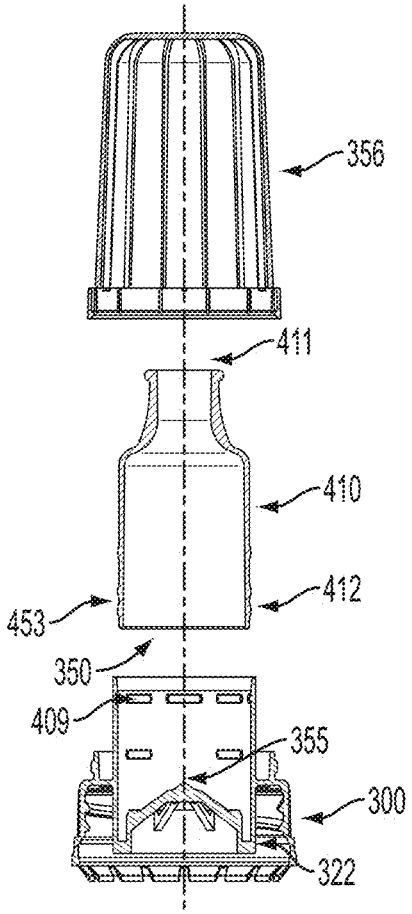
FIG. 20 is a side view of an exemplary chamber with a drink-through top portion and shell with beads.

FIG. 20 shows an exemplary cap device having elongated dust cover 356, top-open chamber 410, and shell 300. Top-open chamber 410 has a top portion opening 411 and a bottom portion 412 having chamber beads 453 disposed on the outer surface. Bottom opening 350 of the chamber can be covered with a film (not shown). In operation, shell 300 can be attached to a container 500 (not shown) having a beverage disposed therein. Top-open chamber 410, containing a composition, can be disposed in shell 300 and dust cover 100 can cover top-open chamber 410 and be removably attached to shell 300. When elongated dust cover 356 is removed, top-open chamber 410 can be actuated into shell 300 and cutting element 355 can pierce the film, releasing the composition into the beverage in container 500. The beverage can be consumed directly through top portion opening 411.

Figure 21:
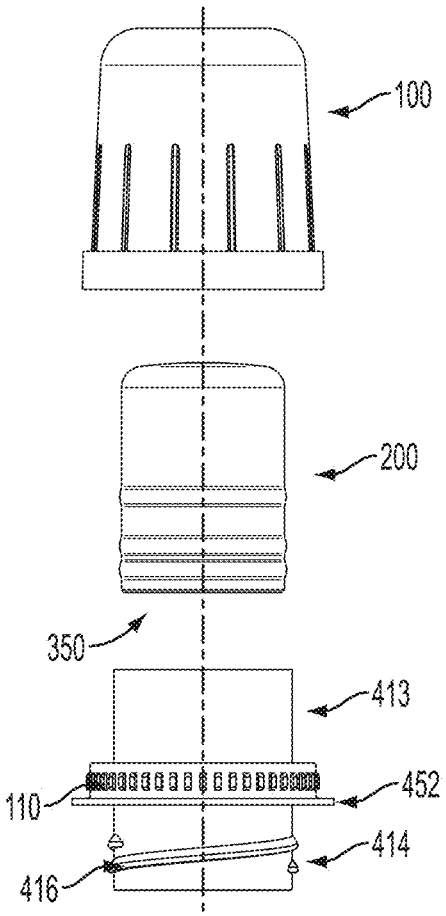
FIG. 21 is a side view of an exemplary cap device having a shell with a shell flange and shell chimney protruding below the shell flange having outer threads.

FIG. 21 shows an exemplary cap device having dust cover 100, chamber 200, and shell 413. In this example, shell 413 has protruding chimney 414 and flange 452. Protruding chimney 414 has chimney threads 416 disposed, for example, on the outside portion of the chimney protruding below flange 452 for associating the shell with container 500 and any suitable resusable container (e.g., reusable water bottle, canteen, thermos etc.). In operation, dust cover 100 is removably attached to flange 452 and chimney threads 416 are removably engaged with threads on container 500 (not shown) or any suitable resusable container. This exemplary cap device can be used with any suitable container including container 500 by engaging chimney threads 416 with the threads on the suitable container.

FIG. 22 shows an aspect of the cap device of FIG. 21 where chamber 200 and shell 413 (not shown) are disposed in reusable container 414 having cap portion 415. After actuation of the chamber 200 into shell 413 and release of the composition in chamber 200 into the reusable container 414, chamber 200 and shell 413 can be removed from reusable container 414 and reusable container 414 can be used in typical operation with cap portion 415.

Figure 23:
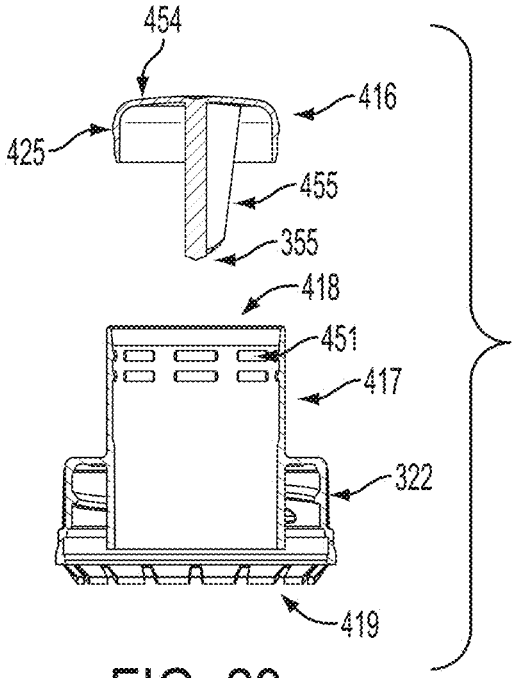
FIG. 23 is a side view of an exemplary cap device with a piercer with a cutting element and a shell.

FIG. 23 shows an exemplary cap device having piercer 416, having top portion 454 and bottom portion 455, and shell 417. Shell 417 has top opening 418 and bottom opening 419, and shell beads 408 disposed on the inner surface. Bottom opening 219 can be covered or partially covered with a film (not shown). Shell 417 can contain a composition. Initially, piercer 416 is located in shell 417 such that the top portion of piercer 416 is substantially flush with the top portion of shell 417 (not shown). In operation, piercer 416 can be actuated into shell 417 piercing the film and releasing the composition into container 500 (not shown). Pierce 416 can optionally have piercer beads 425 disposed on the outer surface of piercer 416 for engaging with shell beads 451 and cutting element 355 for piercing or cutting a film.

Figure 24:
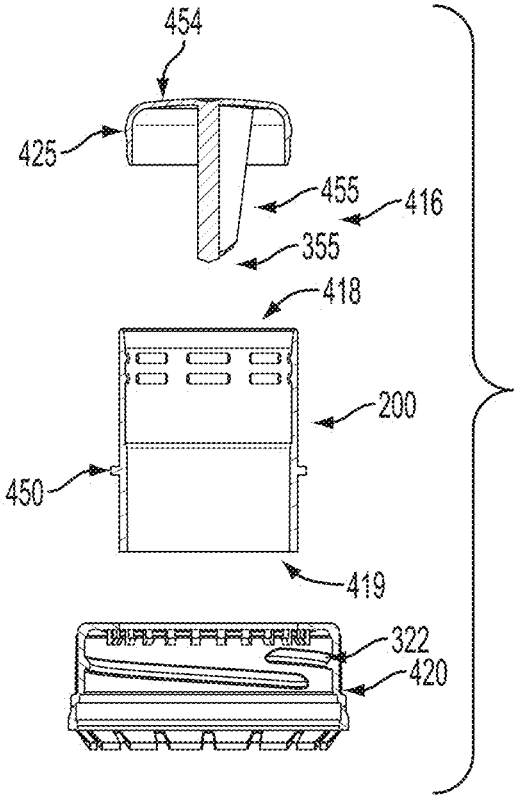
FIG. 24 is a side view of an exemplary cap device having a piercer with a cutting element, a shell with shell protrusions, and a shell base.

FIG. 24 shows an exemplary alternative to the cap device shown in FIG. 23 having piercer 416, chamber 200, and shell base 420. In this example, chamber 200 can be removably associated with shell base 420 by "snapping" chamber 200 into shell base 420. Protrusions 450 provide resistance when "snapping" chamber 200 into shell base 420 and also can retain chamber 200 in shell base 420. Shell base 420 can be associated, for example, with a reusable bottle or container and chamber 200 can be removed after use and replaced with a new chamber 200 containing a composition.

FIG. 25 shows an exemplary alternative to the cap device shown in FIG. 23 having dust cover 100, drink-through piercer 421, and shell 417. In this example, piercer 421 has a drink-through top portion 422 for consuming the beverage after actuation of piercer 421 into shell 417 and release of the composition into a beverage or liquid in the container or bottle.

Figure 26:
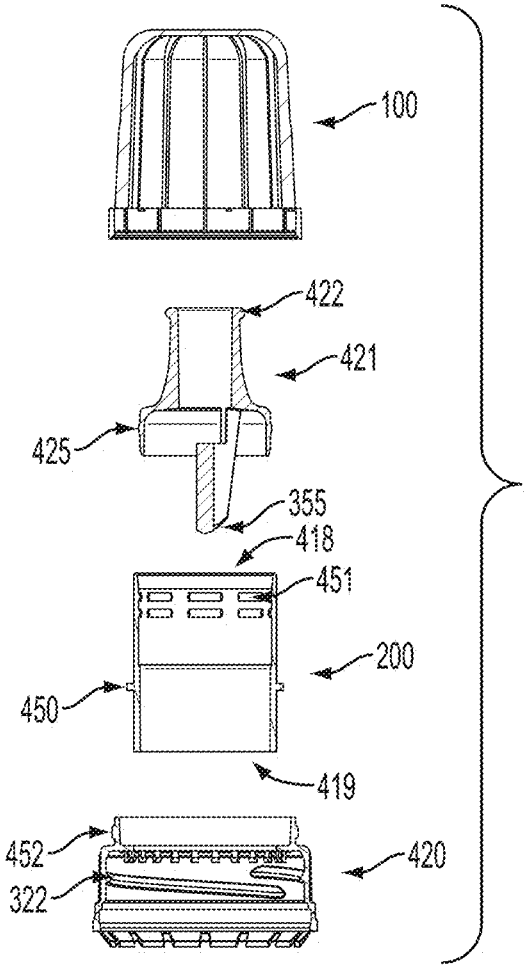
FIG. 26 is a side view of an exemplary cap device having a dust cover, a drink-through piercer with a cutting element, a shell with shell protrusions, and a shell base.

FIG. 26 shows an exemplary alternative to the cap device shown in FIG. 25 having dust cover 100, drink-through piercer 421, shell base 420 and chamber 200. In this example, chamber 200 can be removably associated with shell base 420. Shell base 420 can be associated, for example, with a reusable bottle or container using threads 322 and chamber 200 can be removed after use and replaced with a new chamber 200 containing a composition. In this example, chamber 200 can be removably associated with shell base 420 by "snapping" chamber 200 into shell base 420. Protrusions 450 provide resistance when "snapping" chamber 200 into shell base 420 and also can retain of chamber 200 in shell base 420. Dust cover 100 can be removably "snapped" onto seat protrusions 452 permitting dust cover 100 to function as a removable cap over drink-through piercer 421.

Figure 27:
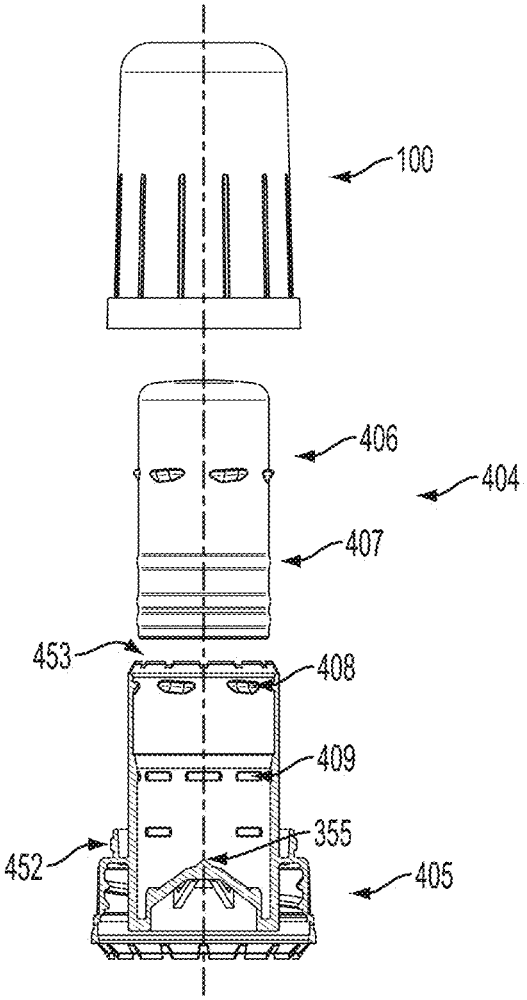
FIG. 27 is a side view of an exemplary cap device having a dust cover, a chamber with discontinuous threads and beads and a shell with a tamper evidence band, discontinuous threads, and beads.

FIG. 27 shows an alternative to the cap device shown in FIG. 19 having exemplary chamber 404 and shell 405. Chamber 404 has chamber threads 406 and chamber beads 407. Shell 405 has shell threads 408 and shell beads 409. Shell 405 also has tamper evidence band 453 disposed around the circumference of the top portion. Tamper evidence band 453 engages with chamber beads 407, for example, to prevent rotation of chamber 404 with respect to shell 405 and "lock" chamber 404 in a position where chamber threads 406 do not align with shell threads 408. In operation, chamber threads 406 and shell threads 408 are aligned after disengaging the threads and breaking the association between tamper evidence band 453 and chamber beads such that chamber threads 406 can fit in between shell threads 408 and chamber 404 can be actuated into shell 405. After chamber 404 is actuated into shell 405, chamber 404 can be rotated such that chamber threads 406 are no longer aligned with shell threads 408 and chamber 404 cannot be readily removed unless chamber beads threads and shell threads 408 are realigned. Chamber threads 406 and shell threads 408 are pictured as discontinuous threads but optionally can be continuous threads. Chamber beads 407 are pictured as continuous beads and shell beads 409 are pictured as discontinuous beads. However, chamber beads and shell beads can be either continuous or discontinuous. Optionally, a dust cover can be used to cover chamber 404 and shell 405.

FIG. 28A shows an alternative to the cap device of FIG. 15A having an exemplary chamber 387 and shell 388. Chamber 387 has an outer portion 389 and inner portion 390, optional opening 393, and tamper skirt 426. Opening 393 can optionally be covered with a film or a replaceable covering. Chamber 387 has circular beads 392 disposed on inner portion 390. Shell 388 has shell beads 391 for engaging with circular beads 392 and a tamper seat 427 for engaging with tamper skirt 426. Chamber locking protrusions 423 are provided for engaging with shell gaps 424.

FIG. 28B shows an assembled chamber and shell of the cap device of FIG. 28A with chamber locking protrusions 423 inserted into and engaged with shell gaps 424 and tamper skirt 426 engaged with tamper seat 427. FIG. 28C shows a further alternative view of the cap device of FIGS. 28A and 28B. Optionally, a dust cover can be used to cover chamber 387 and shell 388.

FIG. 29 shows a cap device having elongated dust cover 428, chamber 200, and lower seat shell 429. In this example, the bottom portion of elongated dust cover 428 extends further onto seating portion 430 on lower seat shell 429. The seat for elongated dust cover 428 is located further towards the distal end of lower seat shell 429 compared to other cap devices where it may be located closer to the mid portion of the shell. In this aspect, the positioning of the dust cover closer to the mouth of the container would alert the consumer the beverage container has a cap device that should be actuated prior to consumption of the beverage.

Figure 30:
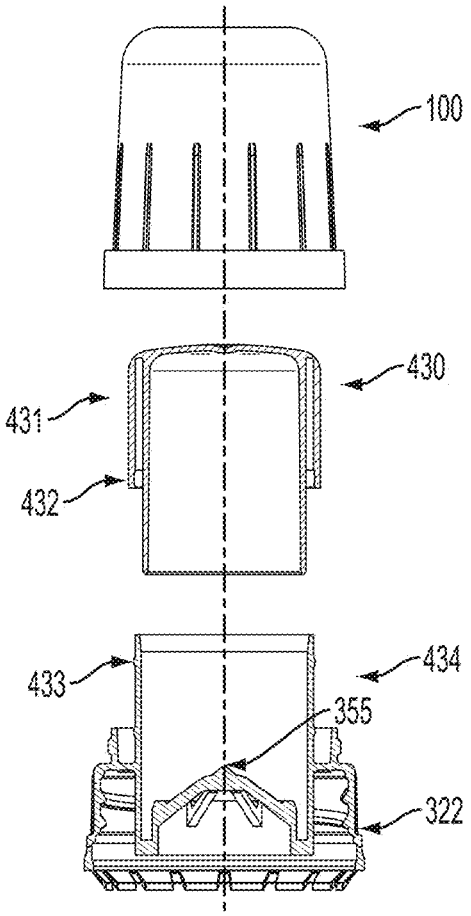
FIGS. 30-33 are side views of exemplary cap devices each having a dust cover, a chamber with an outer skirt and outer structures disposed on the outer skirt, and a shell.

FIG. 30 shows a cap device having dust cover 100, chamber with outer structures 430, shell with outer structures 434. Chamber with outer structures 430 has outer skirt 431 with outer chamber structures 432 disposed on the outer surface of outer skirt 431. Outer chamber structures 432 are adapted to engage with outer shell structures 433 disposed on the outer surface of the chimney of shell with outer structures 434. In this example, outer chamber structures 432 and outer shell structures 433 are beads extend from the outer surface or are convex and adapted to guide chamber with outer structures 430 as it is actuated into shell with outer structures 432.

Figure 31:
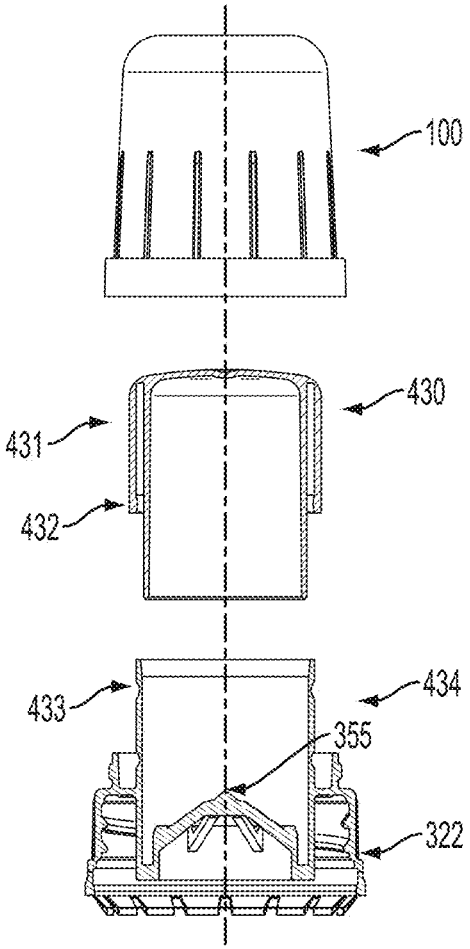

FIG. 31 shows an alternative to the cap device of FIG. 30 where outer chamber structures 432 and outer shell structures 433 form convex indentations in the outer surface of chamber with outer structures 430 and shell with outer structures 432.

Figure 32:
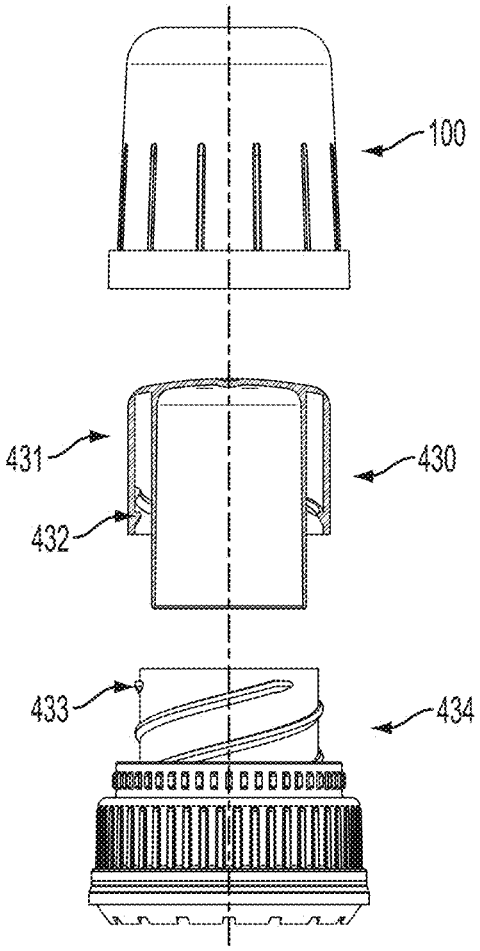

FIG. 32 shows an alternative to the cap device of FIG. 30 where outer chamber structures 432 and outer shell structures 433 are threads adapted to engage and guide chamber with outer structures 430 as it is actuated into shell with outer structures 432.

Figure 33:
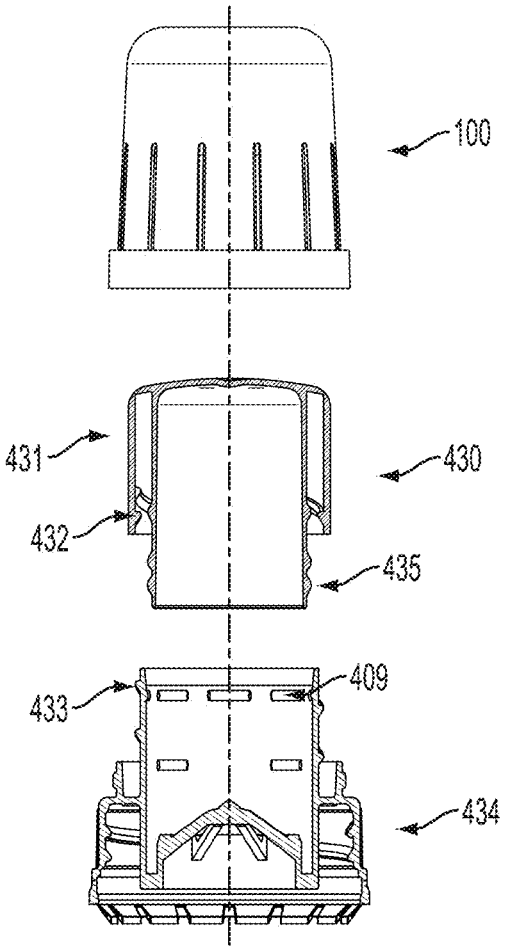

FIG. 33 shows an alternative to the cap device of FIG. 30 where outer chamber structures 432 and outer shell structures 433 are threads adapted to engage and guide chamber with outer structures 430 as it is actuated into shell with outer structures 432. In addition, shell with outer structures 434 has internal beads 409 adapted to engage with beads 435 on the lower portion of chamber with outer structures 430.

Note that while the cap device 600, other cap devices described herein, and associated methods have been described primarily with respect to beverage products, they can also be used with compositions that are designed to be added to containers with other liquids. For example, the cap device 600 could contain the solid components of cement or plaster in the chamber 200 (or any of the exemplary chambers or shells described herein) for addition to a liquid within container 500. The chamber 200 (or any of the exemplary chambers or shells described herein) could also contain a component of an adhesive, such as an epoxy, for addition to a second component of the adhesive within a container 500. Compositions (e.g., fragrances, herbs, vitamins, lotions) for addition to cosmetics or consumer products (e.g., shampoo, cosmetics, mouthwash, etc.) can also be used with the cap devices described herein.

Further, not every element described herein is required. For example, if a tamper-evident seal is not desired, then the elements associated with tamper-evidence may be omitted. As another example, the dust cover may be omitted if it is not desired for a particular end-use of a cap device. In addition, features of particular exemplary chambers, shells, piercers, beads, threads, dust covers, and tamper evidence structures can be utilized in any aspect described herein. Indeed, a person of skill in the art will find numerous additional uses of and variations to the cap devices and methods described herein, which the inventors intend to be limited only by the claims.

What is claimed as new and desired to be protected by Letters Patent of the United States is:

1. A cap device adapted for use with a container comprising:

a shell for associating the cap device with the container, the shell comprising a shell chimney having an inner surface and an outer surface, a shell base, a cutting element for cutting or piercing a film, and at least three sets of locking beads disposed on the inner surface of the shell chimney comprising an uppermost set of locking beads, a middle set of locking beads, and a lower set of locking beads; wherein each set of locking bead comprises one or more locking beads at substantially the same vertical distance from a top portion of the shell; and a chamber for containing a composition, the chamber having one or more side walls, the one or more side walls comprising at least three continuous seal beads for engaging the at least three sets of locking beads, wherein the chamber further comprises one or more top walls attached to the one or more side walls, an opening opposite the one or more top walls and a film covering at least part of the opening, wherein the outer thickness of at least one of the at least three sets of locking beads is about 0.983 inches to about 0.985 inches.

2. A cap device adapted for use with a container comprising:

a shell for associating the cap device with the container, the shell comprising a shell chimney having an inner surface and an outer surface, a shell base, a cutting element for cutting or piercing a film, and at least three sets of locking beads disposed on the inner surface of the shell chimney comprising an uppermost set of locking beads, a middle set of locking beads, and a lower set of locking beads; wherein each set of locking bead comprises one or more locking beads at substantially the same vertical distance from a top portion of the shell; and a chamber for containing a composition, the chamber having one or more side walls, the one or more side walls comprising at least three continuous seal beads for engaging the at least three sets of locking beads, wherein the chamber further comprises one or more top walls attached to the one or more side walls, an opening opposite the one or more top walls and a film covering at least part of the opening wherein the composition has not been exposed to a temperature of more than about 117 F.

* * * * *